US006556799B2

(12) United States Patent
Saito

(10) Patent No.: US 6,556,799 B2
(45) Date of Patent: Apr. 29, 2003

(54) ROTATION MEMBER DRIVING DEVICE AND IMAGE FORMING APPARATUS USING THE SAME

(75) Inventor: Yasuhide Saito, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/900,901

(22) Filed: Jul. 10, 2001

(65) Prior Publication Data

US 2002/0003973 A1 Jan. 10, 2002

(30) Foreign Application Priority Data

Jul. 10, 2000 (JP) ..... 2000-208685

(51) Int. Cl.[7] ..... G03G 15/00
(52) U.S. Cl. ..... 399/167
(58) Field of Search ..... 399/167

(56) References Cited

U.S. PATENT DOCUMENTS 4,803,515 A * 2/1989 Hoshino et al. ..... 399/299

FOREIGN PATENT DOCUMENTS

JP 61-173597 * 8/1986
JP 3-76663 * 4/1991
JP 8-194361 7/1996
JP 9-250606 9/1997

OTHER PUBLICATIONS

Yasushi Nakazato, "Machine Optimizing Technologies for Color Registration of Eletrophotography". Journal of the Imaging Society of Japan, vol. 38, No. 3, 1999, pp. 175–180.

* cited by examiner

*Primary Examiner*—Quana M. Grainger
(74) *Attorney, Agent, or Firm*—Morgan, Lewis & Bockius LLP

(57) ABSTRACT

A rotation member driving device and an image forming apparatus using the same are provided. Without enlarging the device and increasing the cost, by reducing a speed variation generated during one rotation of a rotation member such as an image holding member or an intermediate transfer member, the distortion or color misregistration of an image formed on or transferred onto the rotation member is reduced and a high quality image can be formed. In the rotation member driving device for rotating and driving the rotation member for image formation by a gear attached thereto, a relation between a phase of eccentricity of the rotation member and a phase of a cumulative pitch error in a rotation direction of the gear is set so that a variation of a surface speed due to the eccentricity of the rotation member is restrained from appearing on the image.

6 Claims, 22 Drawing Sheets

DETAIL-X

FIG.17

| No. | LEFT | CENTER | RIGHT |
|---|---|---|---|
| 1 | 7 | 14 | 9 |
| 2 | 6 | 20 | 8 |
| 3 | 7 | 19 | 8 |
| 4 | 4 | 8 | 4 |
| 5 | 4 | 6 | 3 |
| 6 | 5 | 6 | 9 |
| 7 | 2 | 12 | 6 |
| 8 | 5 | 4 | 5 |
| 9 | 3 | 13 | 5 |
| 10 | 4 | 7 | 7 |
| 11 | 8 | 14 | 10 |
| 12 | 8 | 8 | 4 |
| 13 | 6 | 14 | 17 |
| 14 | 4 | 5 | 3 |
| 15 | 6 | 12 | 5 |
| 16 | 6 | 11 | 2 |
| 17 | 1 | 7 | 5 |
| 18 | 4 | 6 | 2 |
| 19 | 5 | 10 | 3 |
| 20 | 5 | 15 | 5 |

| No. | LEFT | CENTER | RIGHT |
|---|---|---|---|
| 21 | 4 | 13 | 4 |
| 22 | 4 | 3 | 3 |
| 23 | 6 | 10 | 4 |
| 24 | 5 | 9 | 6 |
| 25 | 5 | 11 | 7 |
| 26 | 5 | 13 | 3 |
| 27 | 3 | 6 | 3 |
| 28 | 6 | 18 | 15 |
| 29 | 5 | 13 | 8 |
| 30 | 2 | 5 | 5 |
| 31 | 2 | 5 | 6 |
| 32 | 5 | 13 | 7 |
| 33 | 4 | 5 | 5 |
| 34 | 4 | 8 | 4 |
| 35 | 10 | 22 | 7 |
| 36 | 6 | 11 | 6 |
| 37 | 2 | 7 | 3 |
| 38 | 8 | 21 | 17 |
| 39 | 6 | 8 | 6 |
| 40 | 5 | 8 | 5 |

| No. | LEFT | CENTER | RIGHT |
|---|---|---|---|
| 41 | 3 | 5 | 5 |
| 42 | 6 | 6 | 4 |
| 43 | 3 | 5 | 4 |
| 44 | 3 | 9 | 5 |
| 45 | 3 | 7 | 6 |
| 46 | 6 | 10 | 6 |
| 47 | 5 | 13 | 9 |
| 48 | 9 | 15 | 12 |
| 49 | 7 | 13 | 9 |

ROTATION MEMBER DRIVING DEVICE AND IMAGE FORMING APPARATUS USING THE SAME

BACKGROUND OF THE INVENTION

1. Field of the Invention

The present invention relates to a rotation member driving device used for an image forming apparatus adopting an image forming system such as an electrophotographic system, an electrostatic recording system, an ionography, or a magnetic recording system and forming a color or black-and-white image, such as a printer, a copying machine, or a facsimile, and an image forming apparatus using the same, and particularly to a rotation member driving device which can rotate and drive a rotation member such as a photosensitive drum or an intermediate transfer drum with high accuracy and can form a high quality image without distortion and out of color registration as a color or black-and-white image, and an image forming apparatus using the same.

2. Description of the Related Art

Conventionally, as this kind of image forming apparatus adopting an electrophotographic system or the like and forming a color or black-and-white image, such as a printer or a copying machine, ones of various kinds of systems have been proposed and have been put on the market. Especially in recent years, as a personal computer, Internet, digital camera, or the like becomes popular, the development of a color printer is remarkable. In the image forming apparatus such as the color printer, an apparatus for office use, which is capable of forming a color image and satisfies a high speed property, compactness and low cost, similar to those for a black-and-white image, is earnestly demanded.

In the image forming apparatus such as the color printer, in order to form a high quality color image, images of respective colors, such as cyan, magenta, yellow and black, are formed on an image holding member, and it is necessary to improve the accuracy of color registration in superposition of these images of the respective colors.

As the image forming apparatus such as the color printer, there are roughly two types, one adopting a system in which only one photosensitive drum as an image holding member is provided, toner images of respective colors, such as cyan, magenta, yellow and black, are sequentially formed on the one photosensitive drum, and the toner images of the respective colors are multiply transferred onto a recording sheet or an intermediate transfer member, so that a color image is formed, and the other adopting the so-called tandem engine in which image forming units each including a photosensitive drum as an image holding member are provided, the number of the units is made to correspond to the number of colors of toner images to be formed, for example, four in the case of cyan, magenta, yellow and black, toner images of respective colors such as cyan, magenta, yellow and black are continuously formed on the photosensitive drums of the respective image forming units, and the toner images of the respective colors are multiply transferred onto a recording sheet or an intermediate transfer member, so that a color image is formed.

Among these, in the image forming apparatus of the system in which only one photosensitive drum is provided, periodic unevenness of speed of a driving device for driving the photosensitive drum or the intermediate transfer member such as an intermediate transfer drum or an intermediate transfer belt causes the accuracy of the color registration to be degraded. In the image forming apparatus of such system, according to the eccentricity of respect shafts of drive transmission parts of the driving device or the dimension accuracy of a tooth profile of a gear or the like, unevenness of rotation occurs in one rotation period of each of the shafts, and in the case where the photosensitive drum or the intermediate transfer member such as the intermediate transfer drum or the intermediate transfer belt is driven through the drive transmission parts of plural stags, there occurs a speed variation in which the unevenness of the rotation in each of the stages is combined. Thus, in the image forming apparatus of the system, setting is made such that the rotation period of the photosensitive drum is integer times as long as the rotation period of the intermediate transfer drum or the intermediate transfer belt, so that the degradation of the accuracy of the color registration due to the periodic unevenness of speed of a driving device is prevented.

In the latter so-called tandem engine image forming apparatus, since plural (for example, four) image forming units for forming images of respective colors are provided, in order to improve the accuracy of the color registration of the images formed in the respective image forming units, it is necessary to make the positions of the images formed by the respective image forming units coincident with predetermined positions with high accuracy. Thus, the tandem engine image forming unit is constructed such that scan start timing in a main scan direction and a sub-scan direction in an image exposure device for exposing an image by a laser beam onto the photosensitive drum, the phase of a polygon mirror for deflecting and scanning the laser beam, the position of a mirror for guiding the laser beam to the photosensitive drum, and the like are controlled, so that the accuracy of the color registration when the images formed by the respective image forming units are overlapped is improved.

However, the above related art has problems as follows. That is, in the image forming apparatus of the system in which only one photosensitive drum is provided, although it is possible to prevent the accuracy of the color registration from degrading to some degree by setting the rotation period of the photosensitive drum and the rotation period of the intermediate transfer drum or the intermediate transfer belt to have the relation of the integer times, since the image forming apparatus of such system is required to sequentially form the toner images of the respective colors, such as cyan, magenta, yellow and black, for every rotation of the photosensitive drum, there is a problem that it is difficult to satisfy the high speed property required for the color printer for office use, or the like.

On the other hand, in the case of the latter image forming apparatus of the so-called tandem engine, since the toner images of the respective colors, such as cyan, magenta, yellow and black, are continuously formed by the plural image forming units, it is sufficiently possible to satisfy the demand for the high speed property. On the contrary, in this kind of tandem image forming apparatus, in order to improve the accuracy of the color registration, since it becomes necessary to perform correction control of controlling the scan start timing of the image exposure device in the main scan direction and the sub-scan direction, the phase of the polygon mirror, and the position of the mirror for guiding the laser beam to the photosensitive drum, there is a problem that it is difficult to reduce the cost.

Further, in the case of the tandem image forming apparatus, even if the problem of the cost resulting from the correction control of the image exposure device in the respective image forming units is solved, as set forth in "Machine Optimizing Technologies for Color Registration of Electrophotography" (Journal of the Imaging Society of Japan, vol. 38, no. 3 (1999) pp. 175–180), since driving portions of photoreceptor shafts of the respective image forming units are constituted by independent drive transmission parts, it is difficult to improve the accuracy of the color registration by phase alignment of unevenness of one rotation period, the position variation generated by the eccentricity or the like is rather large in view of objective color registration accuracy, and the improvement of the accuracy of the driving part becomes a serious problem, which is pointed out in the publication.

Then, in the tandem image forming apparatus constituted by the independent drive transmission parts for the respective image forming units, in order to improve the accuracy of the driving part, various proposals have been made and actually carried out such that the rotation variation of the photosensitive drum of each of the image forming units is detected by an encoder or the like, and the rotation variation of the photosensitive drum detected by this encoder is controlled by feedback control or feedforward control, or an image signal is outputted in a certain period, its image is read on the photosensitive drum or the transfer drum, and a deviation from the output is fed back, so that the accuracy of the color registration is improved.

However, in this case, a detection part and a control circuit for detecting and controlling the rotation variation of the photosensitive drum of each of the image forming units become complicated, and there are new problems that the apparatus is enlarged and the cost is increased, and it is impossible to meet the demand to provide the color image forming apparatus for office use, which satisfies compactness and low cost.

Then, as a technique which can solve such problems, there is one disclosed in Japanese Patent Unexamined Publication No. Hei. 8-194361 or No. Hei. 9-250606.

In an apparatus for preventing out of color registration of color electrophotography according to Japanese Patent Unexamined Publication No. Hei. 8-194361, an image forming system for color electrophotography is constituted by four process units arranged opposite to a passage of a transfer medium, each of these process units includes a photoreceptor and its subsidiary charging device, writing device, development device, transfer device, and cleaning device, and in an image forming apparatus for multiply transferring images formed on the respective photoreceptors sequentially onto the transfer medium, the photoreceptors are constituted by four photoreceptors of a first photosensitive drum, a second photosensitive drum, a third photosensitive drum, and a fourth photosensitive drum in order of transfer to the transfer medium, there are provided a first drum gear, a second drum gear, a third drum gear, and a fourth drum gear each directly fixed to a shaft of each of the photosensitive drums, the first drum gear and the second drum gear are driven by a first drive gear, and similarly, the third drum gear and the fourth drum gear are driven by a second drive gear, and in the case where the distance between the centers of the adjacent photosensitive drums among the respective photosensitive drums is set to equal to the peripheral length of the photosensitive drum early in the transfer order, the first drum gear and the second drum gear are attached to the shafts of the respective photosensitive drums so that respective maximum eccentricity directions of the first drum gear and the second drum gear become the same, and similarly, the third drum gear and the fourth drum gear are attached to the shafts of the respective photosensitive drums so that respective maximum eccentricity directions of the third drum gear and the fourth drum gear become the same as the case of the first drum gear and the second drum gear.

A gear transmission apparatus and an image forming apparatus of Japanese Patent Unexamined Publication No. Hei. 9-250606 are constructed such that a first gear connected to a drive source side, a second gear connected to a side of an object to be driven, a third gear engaged with the first gear, and a fourth gear attached on the same axis as the third gear and engaged with the second gear are provided, one of the third gear and the fourth gear has the number of teeth an odd number of times as large as the other, and the timing when the variation of rotation speed of the gear by engagement between the first gear and the third gear becomes maximum is almost coincident with the timing when the variation of rotation speed of the gear by engagement between the second gear and the fourth gear becomes maximum.

In the case of the technique disclosed in Japanese Patent Unexamined Publication No. Hei. 8-194361 or No. Hei. 9-250606, the construction is such that the first drum gear and the second drum gear are attached to the shafts of the respective photosensitive drums so that the respective maximum eccentricity directions of the first drum gear and the second drum gear become the same, and similarly, the third drum gear and the fourth drum gear are attached to the shafts of the respective photosensitive drums so that the respective maximum eccentricity directions of the third drum gear and the fourth drum gear become the same as the case of the first drum gear and the second drum gear, or the construction is such that the timing when the variation of the rotation speed of the gear by the engagement between the first gear and the third gear becomes maximum is almost coincident with the timing when the variation of the rotation speed of the gear by the engagement between the second gear and the fourth gear becomes maximum. However, in the case of these techniques, although the phases of the speed variations of the respective photosensitive drums due to the eccentricity of the drum gears or the like can be aligned with each other to some degree, it is impossible to decrease the speed variation generated during one rotation of the photosensitive drum, and they still have a problem that the accuracy of the color registration can not be sufficiently improved. Besides, although there is a disclosure that the timing when the variation of the rotation speed of the gear by the engagement between the first gear and the third gear becomes maximum, its specific method is not disclosed.

SUMMARY OF THE INVENTION

The present invention has been made in view of the above problems and provides a rotation member driving device in which without enlarging the size of the device and without increasing the cost, a speed variation generated during one rotation of a rotation member such as an image holding member or an intermediate transfer member is reduced, so that the distortion and out of color registration of an image formed on or transferred onto the rotation member such as the image holding member or the intermediate transfer member is reduced, and a high quality image can be formed, and an image forming apparatus using the same.

According an aspect of the present invention, the rotation member driving device has a rotation member for forming an image, having an eccentricity, and a gear attached to the rotation member for rotating thereof. In the device, a relation between a phase of the eccentricity of the rotation member and a phase of a cumulative pitch error in a direction of rotation of the gear is set so that a variation of a surface speed of the rotation member due to the eccentricity thereof is restrained from appearing on an image to be formed.

When a position where the eccentricity of the rotation member is relatively large is moved to an image-forming position, the cumulative pitch error of the gear in the rotation direction may become relatively small at an engagement position of the gear.

Furthermore, when neighborhood of a phase where the eccentricity of the rotation member is approximately maximum is moved to an image-forming position, the cumulative pitch error of the gear in the direction of rotation may become approximately minimum at an engaging position of the gear.

In the device, marks may be respectively provided at a position where the eccentricity of the rotation member becomes maximum and a position where the cumulative pitch error of the gear in the rotation direction becomes minimum, and the gear may be attached to the rotation member in accordance with the marks.

The image-forming position of the rotation member and the engagement position of the gear may be set to be substantially opposite positions or substantially same positions.

According to another aspect of the present invention, the image forming apparatus has an image holding member having an eccentricity and a gear attached to the image holding member for rotating thereof. When a position of the image holding member where the eccentricity is relatively large is moved to a position where exposure is performed, a cumulative pitch error of the gear in a direction of rotation becomes relatively small at an engaging position thereof.

According to another aspect of the present invention, the image forming apparatus has an image holding member that holds an image, at least one intermediate transfer member having an eccentricity, onto which the image is transferred, and a gear attached to the intermediate transfer member for rotating thereof. When a position of the at least one intermediate transfer member where the eccentricity is relatively large is moved to an image transfer position, a cumulative pitch error of the gear in a direction of rotation becomes relatively small at an engaging position thereof.

According to another aspect of the present invention, the image forming apparatus forms a color image by forming latent images respectively according to pieces of input information of plural colors, developing the latent images with toners of corresponding colors to obtain plural single-color toner images, and fixing the plural single-color toner images on a recording medium. The image forming apparatus has at least three image holding members on which latent images respectively corresponding to pieces of input information of plural colors are formed, and the latent images are developed with toners of corresponding colors to form plural single-color toner images, a gear attached to each of the at least three image holding members for rotating thereof, at least one intermediate transfer member which is disposed in contact with or close to the image holding member and to which the single-color toner images formed on the image holding members are transferred, and a final transfer rotation member for transferring the toner images transferred onto the at least one intermediate transfer member to a recording medium. At least two image transferring cycles are performed, and when a position of the image holding member where eccentricity is relatively large is moved to a position where exposure is performed, a cumulative pitch error of the gear in a rotation direction becomes relatively small at an engagement position of the gear.

According to another aspect of the present invention, the image forming apparatus also forms a color image by forming latent images respectively according to pieces of input information of plural colors, developing the latent images with toners of corresponding colors to obtain plural single-color toner images, and fixing the plural single-color toner images on a recording medium. The apparatus has a single image holding member on which latent images respectively corresponding to pieces of input information of plural colors are sequentially formed and the latent images are developed with toners of corresponding colors to form plural single-color toner images sequentially, a gear attached to the image holding member for rotating thereof, at least one intermediate transfer member which is disposed in contact with or close to the image holding member and to which the single-color toner images formed on the image holding member are transferred, and a final transfer rotation member for transferring the toner images transferred onto the at least one intermediate transfer member to a recording medium. At least two image transferring cycles are performed, and when a position of the image holding member where eccentricity is relatively large is moved to a position where exposure is performed, a cumulative pitch error of the gear in a rotation direction becomes relatively small at an engagement position of the gear.

BRIEF DESCRIPTION OF THE DRAWINGS

Preferred embodiments of the present invention will be described in detail based on the following figures, wherein:

FIG. 17 is a graph showing measurement data of eccentricity of photosensitive drums;

DETAILED DESCRIPTION OF THE PREFERRED EMBODIMENTS

Embodiments of the present invention will be hereinafter described with reference to the drawings.

Embodiment 1

Figure 2:
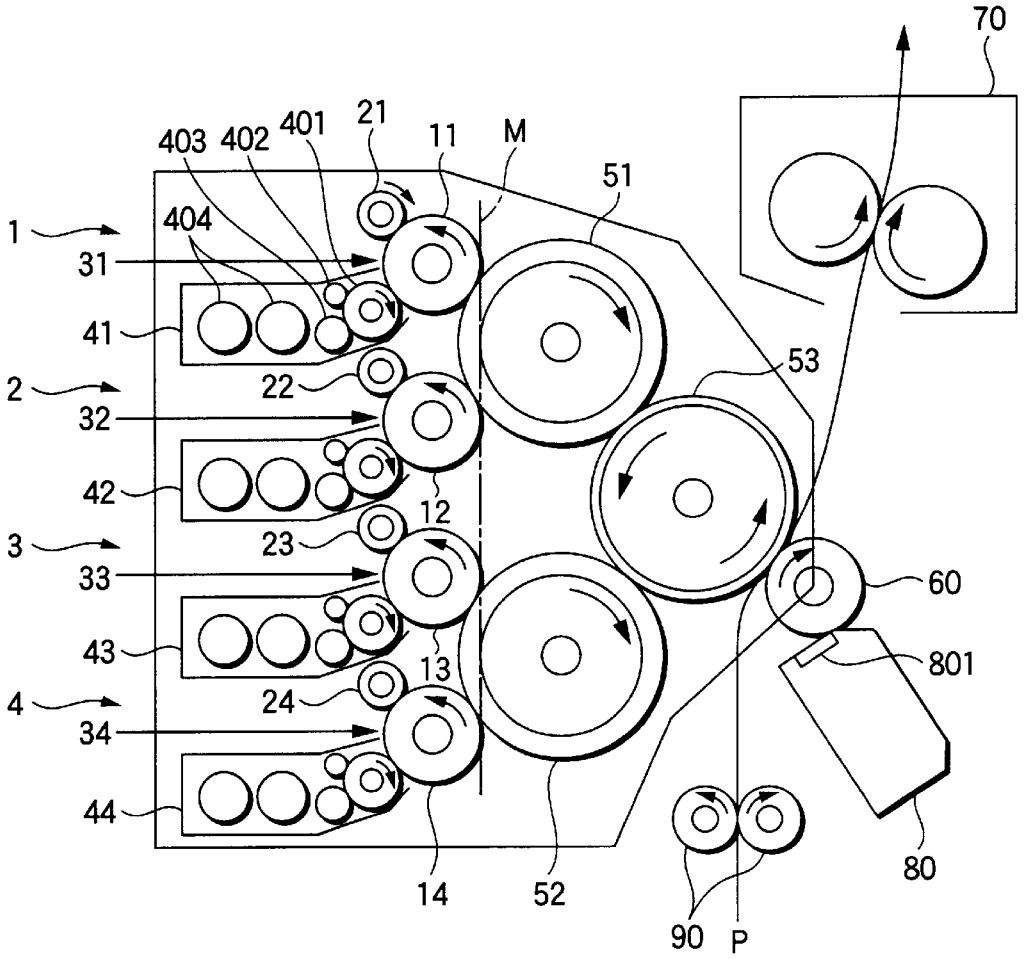
FIG. 2 is a structural view showing the color printer as the image forming apparatus to which the rotation member driving device according to the first embodiment of the present invention is applied.

FIG. 2 shows a tandem full-color printer as an image forming apparatus to which a rotation member driving device according to a first embodiment of the present invention is applied. Incidentally, arrows in FIG. 2 indicate rotation directions of respective rotation members.

As shown in FIG. 2, a main portion of the full-color printer is constituted by image forming units 1, 2, 3 and 4 including respective photosensitive drums (image holding members) 11, 12, 13 and 14 for cyan (C), magenta (M), yellow (Y) and black (k), charging rolls (contact type charging devices) 21, 22, 23 and 24 for primary charging, which are in contact with these photosensitive drums 11, 12, 13 and 14, not-shown laser optical units (exposure devices) for irradiating respective color laser lights 31, 32, 33 and 34 of respective colors of cyan (C), magenta (M), yellow (Y) and black (k), development devices 41, 42, 43 and 44, a first primary intermediate transfer drum (intermediate transfer member) 51 in contact with the two photosensitive drums 11 and 12 of the four photosensitive drums 11, 12, 13 and 14, a second primary intermediate transfer drum (intermediate transfer member) 52 in contact with the other two photosensitive drums 13 and 14, a secondary intermediate transfer drum (intermediate transfer member) 53 in contact with the first and the second primary intermediate transfer drums 51 and 52, and a final transfer roll (transfer member) 60 in contact with the secondary intermediate transfer drum 53.

The photosensitive drums 11, 12, 13 and 14 are arranged at constant intervals to have a common tangent plane M. The first primary intermediate transfer drum 51 and the second primary intermediate transfer drum 52 are arranged so that the respective rotation shafts are in parallel with the shafts of the photosensitive drums 11, 12, 13 and 14 and a plane symmetry relation with a predetermined symmetrical plane as a boundary is established. Further, the secondary intermediate transfer drum 53 is arranged so that the rotation shaft is in parallel with the photosensitive drums 11, 12, 13 and 14.

Signals corresponding to image information of the respective colors are rasterized by a not-shown image processing unit and are inputted to the laser optical units. In this laser optical unit, based on the image information of the respective colors, the laser lights 31, 32, 33 and 34 of the respective colors of cyan (C), magenta (M), yellow (Y) and black (k) are modulated and are irradiated to the photosensitive drums 11, 12, 13 and 14 of the corresponding colors.

Image formation processes for the respective colors by a well-known electrophotography system are carried out around the photosensitive drums 11, 12, 13 and 14. First, as each of the photosensitive drums 11, 12, 13 and 14, for example, a photosensitive drum using an OPC photoreceptor of a diameter of 20 mm is used, and these photosensitive drums 11, 12, 13 and 14 are rotated and driven by an after-mentioned rotation member driving device at a rotation speed of a surface speed of 95 mm/sec. The surfaces of the photosensitive drums 11, 12, 13 and 14 are, as shown in FIG. 2, charged to about −300 V by applying a DC voltage of about −840 V to the charging rolls 12, 22, 32 and 42 as the contact type charging devices. Incidentally, as the contact type charging device, although a roll type one, a film type one, a brush type one, or the like can be named, any type may be used. In this embodiment, a charging roll used in an electrophotography device in recent years is adopted. In this embodiment, although a charging system of only DC application is adopted to charge the surfaces of the photosensitive drums 11, 12, 13 and 14, a charging system of AC+DC application may be used.

Thereafter, the surfaces of the photosensitive drums 11, 12, 13 and 14 are irradiated with the laser lights 31, 32, 33 and 34 corresponding to the respective colors of cyan (C), magenta (M), yellow (Y) and black (k) by the not-shown laser optical units as the exposure devices, and electrostatic latent images corresponding to the input image information of the respective colors are formed. With respect to the photosensitive drums 11, 12, 13 and 14, when the electrostatic latent images are written by the laser optical units, electricity is removed so that the surface potential of the image exposure portion becomes, for example, about −60 V or less.

The electrostatic latent images formed on the surfaces of the photosensitive drums 11, 12, 13 and 14 and corresponding to the respective colors of cyan (C), magenta (M), yellow (Y) and black (k) are developed by the development devices 41, 42, 43 and 44 of the corresponding colors, and are visualized as toner images of the respective colors of cyan (C), magenta (M), yellow (Y) and black (k).

In this embodiment, as the development devices 41, 42, 43 and 44, although a magnetic brush contact type two-component development system is adopted, the scope of application of the present invention is not limited to this development system, but it is needless to say that the present invention can be sufficiently applied to other development systems such as a non-contact type development system.

The development devices 41, 42, 43 and 44 are respectively filled with developers composed of different color toners of cyan (C), magenta (M), yellow (Y) and black (k) and carriers. In these development devices 41, 42, 43 and 44, when the toners are supplied from a not-shown toner supply device, the supplied toners are sufficiently mixed with the carriers by an auger 404 and are frictionally charged. In the inside of a development roll 401, a magnet roll (not shown) in which plural magnetic poles are arranged at predetermined angles is arranged in a fixed state. In the developers transported to the vicinity of the surface of the development roll 401 by a paddle 403 for transporting the developers to the development roll 401, the amount of the developers transported to the development portion is regulated by a developer amount regulating member 402. In this embodiment, the amount of the developers is 30 to 50 g/m$^2$, and the charging amount of the toners existing on the developer roll 401 is approximately −20 to 35 $\mu$C/g.

The toners supplied onto the development roll 401 are formed into magnetic brush shapes constituted by the carriers and toners by the magnetic force of the magnet roll, and the magnetic brushes are in contact with the photosensitive drums 11, 12, 13 and 14. An AC+DC development bias voltage is applied to this development roll 401 and the toners on the development rolls 401 are developed to the electrostatic latent images formed on the photosensitive drums 11, 12, 13 and 14, so that the toner images are formed. In this embodiment, the development bias voltage is AC of 4 kHz and 1.5 kVpp and DC of approximately −230 V.

Next, the toner images of the respective colors of cyan (C), magenta (M), yellow (Y) and black (k) formed on the photosensitive drums 11, 12, 13 and 14 are electrostatically secondary transferred onto the first primary intermediate transfer drum 51 and the second primary intermediate transfer drum 52. The toner images of cyan (C) and magenta (M) formed on the photosensitive drums 11 and 12 are transferred onto the first primary intermediate transfer drum 51, and the toner images of yellow (Y) and black (k) formed on the photosensitive drums 13 and 14 are transferred onto the second primary intermediate transfer drum 52. Thus, a single color image transferred from either one of the photosensitive drums 11 and 12 and a double color image in which toner images of two colors transferred from both the photosensitive drums 11 and 12 are overlapped, are formed on the first primary intermediate transfer drum 51. Also, a similar single color image and double color image from the photosensitive drums 13 and 14 are formed on the second primary intermediate transfer drum 52.

A surface potential necessary for electrostatically transferring the toner images onto the first and the second primary intermediate transfer drums 51 and 52 from the photosensitive drums 11, 12, 13 and 14 is about +250 to 500 V. This surface potential is set to an optimum value according to the charging state of toner, ambient temperature, and humidity. This ambient temperature and humidity can be simply known by detecting a resistance value of a member having characteristics in which its resistance value is changed by the ambient temperature and humidity. As described above, in the case where the charging amount of toner is in the range of −20 to 35 $\mu$C/g, and under the environment of normal temperature and normal humidity, it is desirable that the surface potential of the first and the second primary intermediate transfer drums 51 and 52 is about +380 V.

Figure 3:
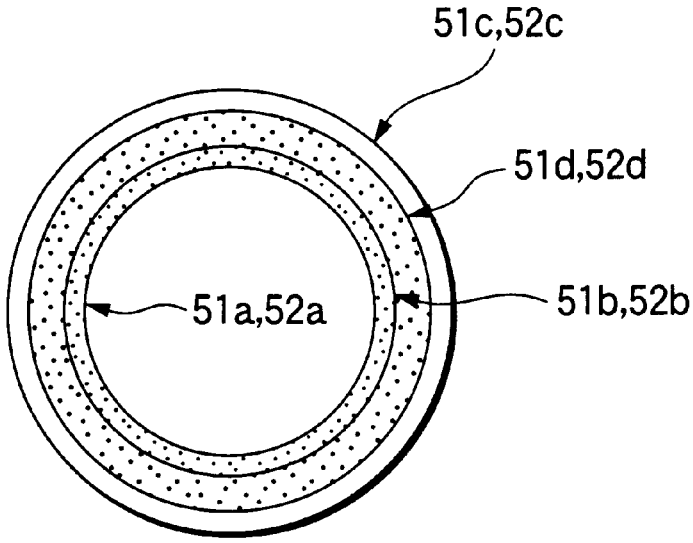
FIG. 3 is a sectional view showing an intermediate transfer drum.

The first and the second primary intermediate transfer drums 51 and 52 used in this embodiment are respectively formed to have, for example, an outer diameter of 42 mm and a resistance value of about $10^8$ Ω. The first and the second primary intermediate transfer drums 51 and 52 are cylindrical rotation members in which the surface made of a single layer or plural layers has flexibility or elasticity, and in general, as shown in FIG. 3, low resistance elastic rubber layers 51*b* and 52*b* (R=$10^2$ to $10^3$ Ω) typified by conductive silicon rubber or the like and having a thickness of about 0.1 to 10 mm are provided on metal pipes 51*a* and 52*a* as metallic cores made of Fe, Al or the like. Further, the outermost surfaces of the first and the second intermediate transfer drums 51 and 52 are formed as high release layers 51*c* and 52*c* (R=$10^5$ to $10^9$ Ω) made of fluorine rubber in which fluorine resin fine particles are dispersed and which has a thickness of 3 to 100 $\mu$m, and they are bonded with adhesives 51*d* and 52*d* (primer) of a silane coupling agent system. Here, the resistance value and the release property of the surface are important, and as long as a material has a resistance value of R=$10^5$ to $10^9$ Ω and a high release property, the material does not have other particular limitations.

Like this, the single color or double color toner images formed on the first and the second primary intermediate transfer drums 51 and 52 are electrically secondary transferred onto the secondary intermediate transfer drum 53. Thus, final toner images from the single color image to quadruple color image of cyan (C), magenta (M), yellow (Y) and black (k) are formed on the secondary intermediate transfer drum 53.

The surface potential necessary for electrostatically transferring the toner image onto the secondary intermediate transfer drum 53 from the first and the second primary intermediate transfer drums 51 and 52 is about +600 to 1200 V. This surface potential is set to an optimum value according to the charging state of toner, ambient temperature, and humidity, similarly to the transfer from the photosensitive drums 11, 12, 13 and 14 to the first primary intermediate transfer drum 51 and the second primary intermediate transfer drum 52. Besides, since what is required for transfer is a potential difference between the first and second primary intermediate transfer drums 51, 52 and the secondary intermediate transfer drum 53, it is necessary to set a value corresponding to the surface potential of the first and second primary intermediate transfer drums 51, 52. As described above, in the case where the charging amount of the toner is in the range of −20 to 35 $\mu$C/g, and the temperature and humidity are normal, and further, the surface potential of the first and the second primary intermediate transfer drums 51 and 52 is about +380 V, it is desirable that the surface potential of the secondary intermediate transfer drum 53 is set to about +880 V, that is, the potential difference between the first and second primary intermediate transfer drums 51, 52 and the secondary intermediate transfer drum 53 is set to about +500 V.

The secondary intermediate transfer drum 53 used in this embodiment is formed to have, for example, an outer diameter of 42 mm which is the same as the first and second primary intermediate transfer drums 51, 52, and its resistance value is set to about $10^{11}$ Ω. Besides, the secondary intermediate transfer drum 53 is also a cylindrical rotation member and its surface made of a single layer or plural layers has flexibility or elasticity, similarly to the first and second primary intermediate transfer drums 51, 52. In general, a low resistance elastic rubber layer (R=$10^2$ to $10^3$ Ω) typified by conductive silicone rubber or the like and having a thickness of about 0.1 to 10 mm is provided on a metal pipe as a metallic core made of Fe, Al or the like. Further, the outermost surface of the secondary intermediate transfer drum 53 is formed as a high release layer made of fluorine rubber in which fluorine resin fine particles are dispersed and which has a thickness of 3 to 100 $\mu$m, and it is bonded with an adhesive (primer) of a silane coupling agent system. Here, it is necessary that the resistance value of the secondary intermediate transfer drum 53 is set to be higher than that of the first and second primary intermediate transfer drums 51, 52. If not, the secondary intermediate transfer drum 53 charges the first and second primary intermediate transfer drums 51, 52, and it becomes difficult to control the surface potentials of the first and second primary intermediate transfer drums 51, 52. As long as a material satisfies such conditions, the material does not have other particular limitations.

Next, the final toner images of from the single color image to the quadruple color image formed on the secondary intermediate transfer drum 53 are tertiary transferred by the final transfer roll 60 onto a sheet passing through a sheet transporting passage P. This sheet passes through a sheet transport roll 90 via a not-shown sheet feeding step, and is sent to a nip portion between the secondary intermediate transfer drum 53 and the final transfer roll 60. After this final transfer step, the final toner image formed on the sheet is fixed by a fixing unit 70 and a series of image forming processes are completed.

Figure 4:
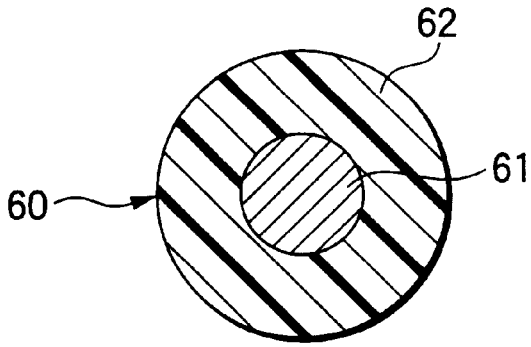
FIG. 4 is a sectional view showing a final transfer roll.

The final transfer roll 60 is formed to have, for example, an outer diameter of 20 mm, and its resistance value is set to about $10^8$ Ω. As shown in FIG. 4, this final transfer roll 60 is constructed such that a coating layer 62 made of urethane rubber or the like is provided on a metal shaft 61, and if necessary, coating is applied thereon. An optimum value of voltage applied to the final transfer roll 60 varies according to ambient temperature, humidity, kind of sheet (resistance value, etc.), and the like, and is approximately +1200 to 5000 V. In this embodiment, a constant current system is adopted, a current of about +6 μA is applied under normal temperature and normal humidity, and almost proper transfer voltage (+1600 to 2000 V) is obtained.

Incidentally, the toner remaining on the secondary intermediate transfer drum 53 or the like is collected in a cleaning step by providing a potential gradient to the final transfer roll 60, and is removed by a cleaning blade 801 or the like of a cleaning device 80 urged against the surface of the final transfer roll 60.

Figure 5:
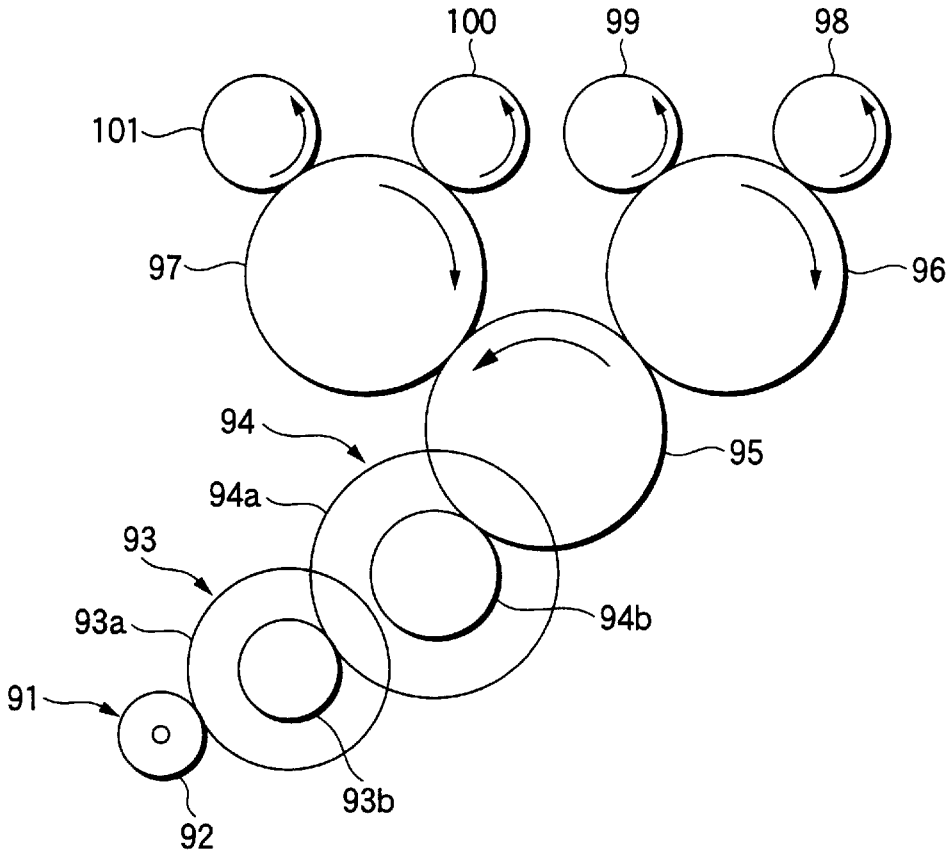
FIG. 5 is a structural view showing a driving system of the color printer as the image forming apparatus to which the rotation member driving device according to the first embodiment of the present invention is applied.
Figure 6:
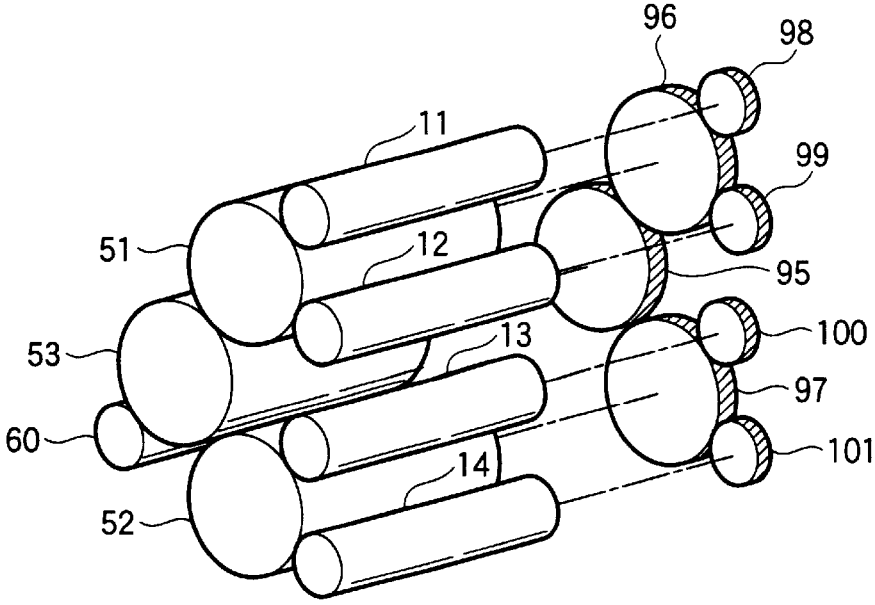
FIG. 6 is a perspective structural view showing the driving system of the color printer as the image forming apparatus to which the rotation member driving device according to the first embodiment of the present invention is applied.

FIGS. 5 and 6 are a front structural view and a perspective structural view showing a rotation member driving device applied to a tandem full-color printer constructed as described above. This driving device is constituted by a motor and a driving system for transmitting a driving force by an integral gear train.

A driving gear 92 is attached to a driving shaft of a driving motor 91 typified by a DC brushless motor or a stepping motor, and this driving gear 92 is engaged with a first intermediate transfer gear 95 attached to an end portion of the third intermediate transfer drum 53 through a first stage and a second stage reduction gears 93 and 94. The first stage reduction gear 93 is constituted by an idle gear 93*a* having a large diameter and an idle gear 93*b* having a small diameter fixed on the same axis, and the second stage reduction gear 94 is constituted by an idle gear 94*a* having a large diameter and an idle gear 94*b* having a small diameter fixed on the same axis. In the first stage reduction gear 93, the idle gear 93*a* having the large diameter is engaged with the driving gear 92, and the idle gear 93*b* having the small diameter is engaged with the idle gear 94*a* having the large diameter of the second reduction gear 94. Further, in the second stage reduction gear 94, the idle gear 94*b* having the small diameter is engaged with the first intermediate transfer gear 95 attached to the end portion of the third intermediate transfer drum 53.

Besides, the first intermediate transfer gear 95 attached to the end portion of the third intermediate transfer drum 53 is engaged with a second and a third intermediate transfer gears 96 and 97 attached to the end portions of the first and the second intermediate transfer drums 51 and 52. Among the second and the third intermediate transfer gears 96 and 97, the second intermediate transfer gear 96 is engaged with photoreceptor gears 13 and 44 attached to end portions of the photosensitive drums 11 and 12, and the third intermediate transfer gear 97 is engaged with photoreceptor gears 100 and 101 attached to end portions of the photosensitive drums 98 and 99. Incidentally, all gears used here are constituted by helical gears, and although it is preferable to use the helical gear in view of transmission characteristics of driving force, the present invention is not limited to this, but a spur gear or the like may be used.

Figure 7A:
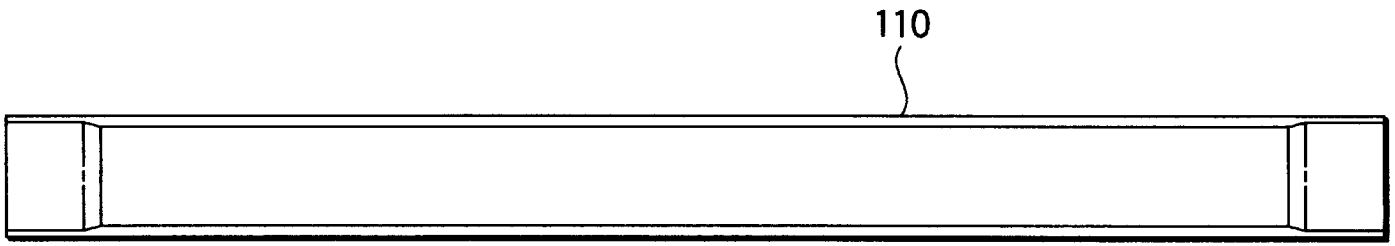
FIGS. 7A and 7B are a sectional view and a front view sowing a photosensitive drum except for a gear member.
Figure 7B:
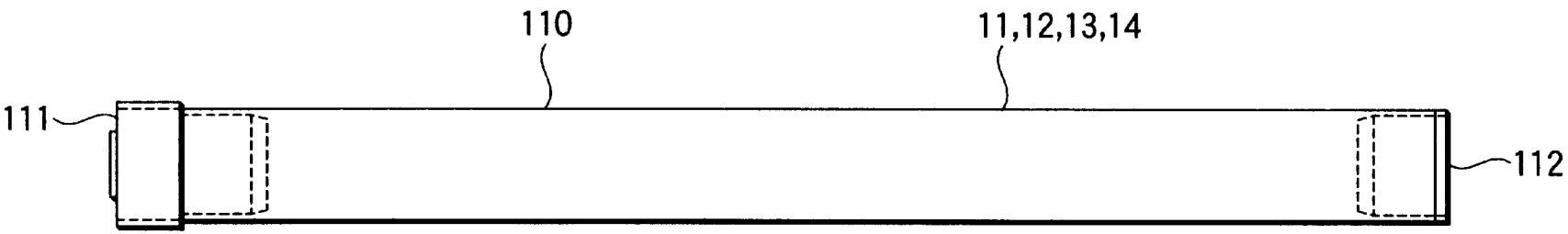

As the respective photosensitive drums 11, 12, 13 and 14, as shown in FIGS. 7A and 7B, there are used drums each obtained by forming a photosensitive layer made of OPC (Organic Photo Conductor) or the like on the surface of a thin cylindrical base body 110 made of metal such as aluminum. Besides, a synthetic resin gear member 111 constituting the photoreceptor gear 98, 99, 100 or 101 made of the helical gear is attached to one end of each of the photosensitive drums 11, 12, 13 and 14 by a method such as press insertion, and a flange member 112 made of synthetic resin is similarly attached to the other end by a method such as press insertion.

Figure 8A:
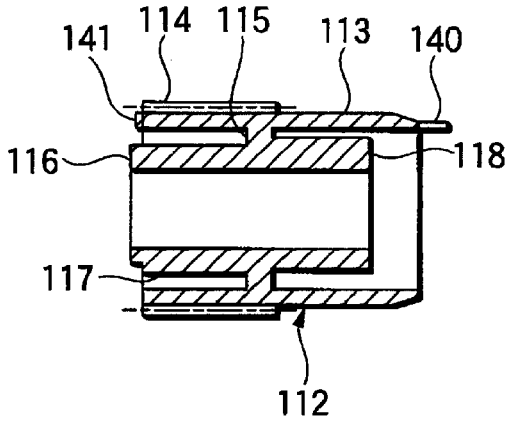
FIGS. 8A to 8E are views showing a gear member, respectively.
Figure 8D:
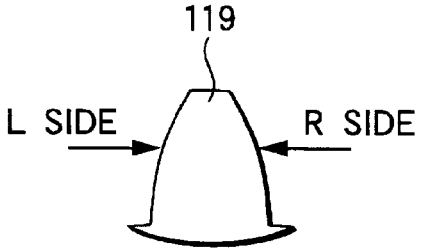
Figure 8B:
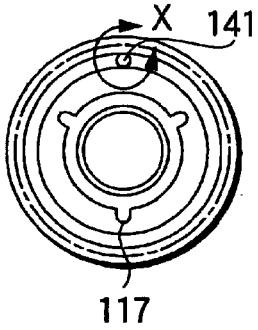
Figure 8E:
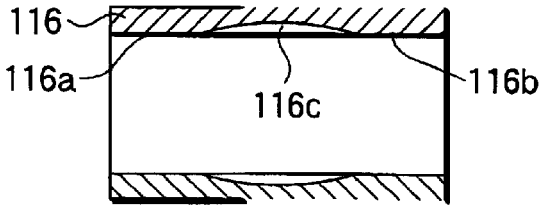
Figure 8C:
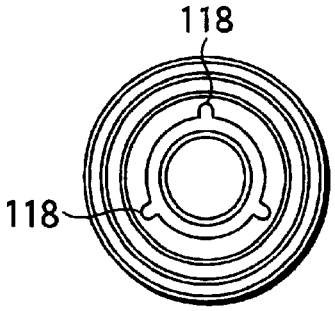

As shown in FIGS. 8A to 8E, the gear member 111 is formed into a substantially double cylindrical shape by injection molding of synthetic resin, or the like, and the outer diameter of a portion 113 at one end side of an outside cylindrical portion 112 is set so that it is press inserted into the cylindrical base body 110 of each of the photosensitive drums 11, 12, 13 and 14. Besides, the photoreceptor gear 98, 99, 100 or 101 made of the helical gear is formed on the outer periphery of a portion 114 at the other end side of the outside cylindrical portion 112. As shown in FIG. 8D, a tooth 119 of the photoreceptor gears 98, 99, 100 and 101 is set so that a basic tooth profile is made of an involute tooth profile of JIS B1701, the number of teeth is 40, and a module is 0.45. Further, in the inside of the outside cylindrical portion 112, an inside cylindrical portion 116 is integrally provided at an inside end portion of the photoreceptor gear 98, 99, 100 or 101 through a coupling portion 115 provided in a radial direction. This inside cylindrical portion 116 is for allowing a shaft axially supporting the photosensitive drum 11, 12, 13 or 14 to be inserted in a fixed state. As shown in FIG. 8E, in the inside cylindrical portion 116, inner dimensions of both end portions 116*a* and 116*b* in the axial direction are formed to be predetermined values with high accuracy, and a center portion 116*c* positioned between both the end portions 116*a* and 116*b* is set so that an inner diameter is slightly larger than both the end portions 116*a* and 116*b* in a range where injection molding can be made. By doing so, the shaft axially supporting the photosensitive drum 11, 12, 13 or 14 can be supported and fixed by both the end portions 116*a* and 116*b* of the inside cylindrical portion 116 with high accuracy, and it becomes possible to keep the diameter dimension with high accuracy at the side of the end portion 116*a* where the photoreceptor gear 98, 99, 100 or 101 is provided. Incidentally, in FIG. 8, reference numerals 117 and 118 designate reinforcing ribs of the inside cylindrical portion 116, respectively.

Figure 9A:
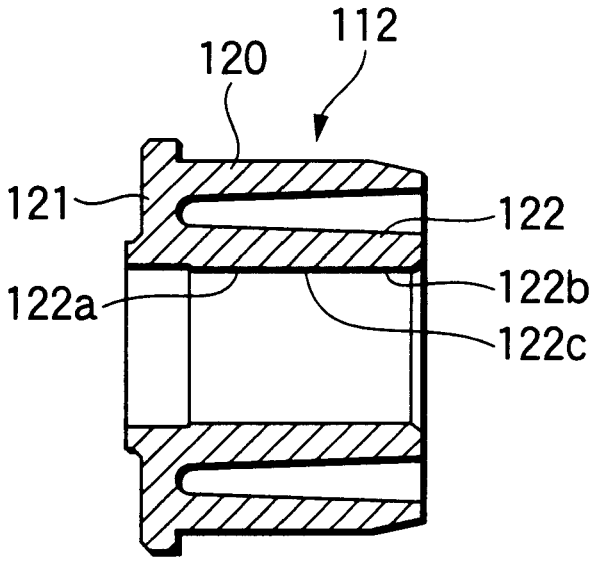
FIGS. 9A and 9B are views showing a flange member, respectively.
Figure 9B:
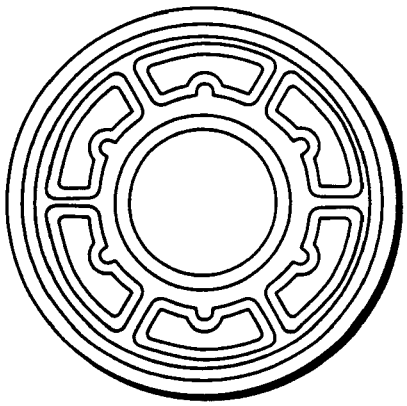

On the other hand, as shown in FIGS. 9A and 9B, the flange member 112 is formed into a substantially double cylindrical shape by injection molding of synthetic resin, or the like, and an outer diameter of an outside cylindrical portion 120 is set so that it can be press inserted in the cylindrical base body 110 of the photosensitive drum 11, 12, 13 or 14. An annular flange portion 121 is provided at the outside end portion of the flange member 112, and the outside cylindrical portion 120 and an inside cylindrical portion 122 are coupled with each other through the flange portion 121. Besides, in the inside cylindrical portion 122, similarly to the gear member 111, inner diameter dimensions of both end portions 122*a* and 122*b* in the axial direction are formed to be predetermined values with high accuracy, and a center portion 122*c* positioned between both the end portions 122*a* and 122*b* is set so that its inner diameter is slightly larger than both the end portions 122*a* and 122*b*. By doing so, it becomes possible to support and fix the shaft axially supporting the photosensitive drum 11, 12, 13 or 14 by both the end portions 122*a* and 122*b* of the inside cylindrical portion 122 with high accuracy.

Figure 10:
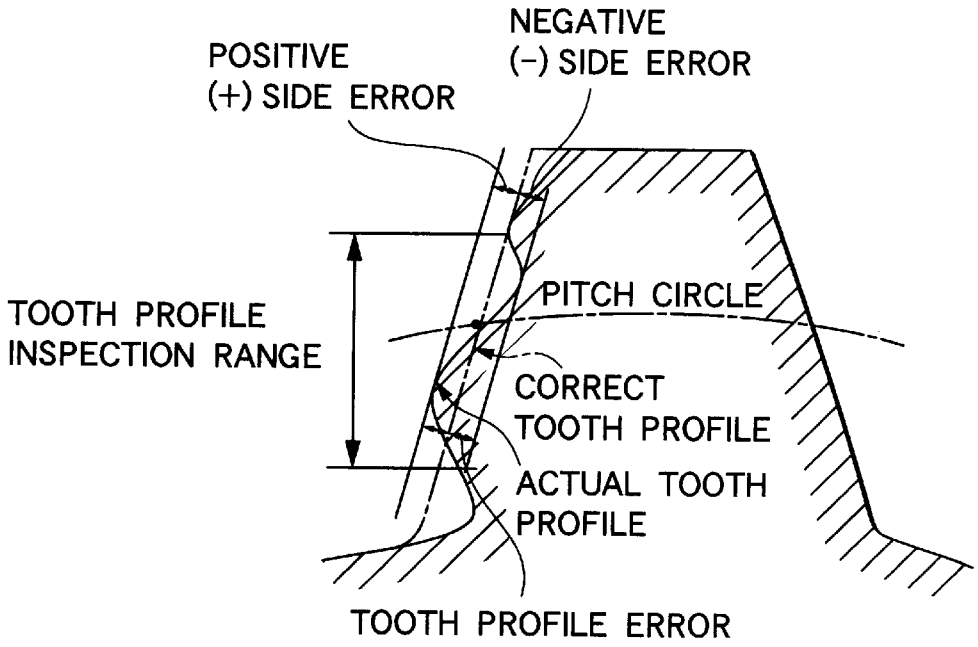
FIG. 10 is an explanatory view showing an error of a gear.

In the photoreceptor gears 98, 99, 100 and 101 constructed as described above, although the basic tooth profile is ideally made of the involute tooth profile of JIS B1701, since the photoreceptor gears 98, 99, 100 and 101 are manufactured by, for example, injection molding using synthetic resin, an actual tooth profile has an error to a positive (+) side or a negative (−) side with respect to a correct tooth profile, as shown in FIG. 10.

Figure 11:
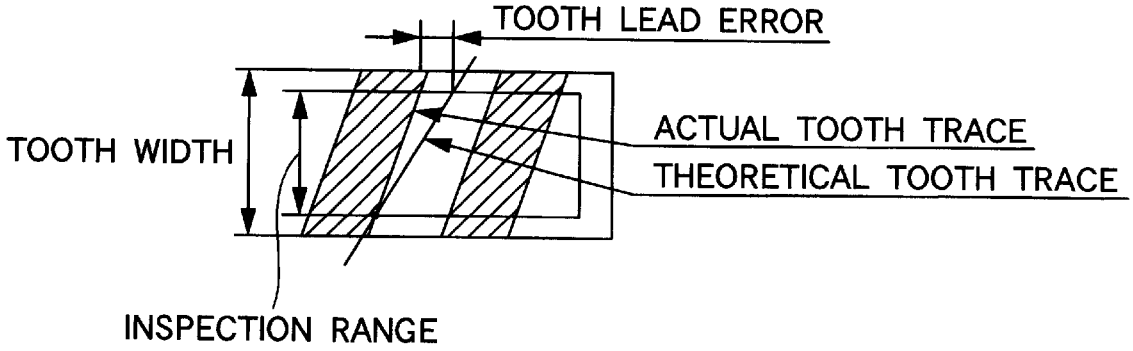
FIG. 11 is an explanatory view showing an error of a gear.

In the helical gear used as the photoreceptor gear 98, 99, 100, 101, or the like, it is regulated by JIS B1702 of JIS standard or the like that the accuracy is evaluated through a single pitch error, pitch variation, cumulative pitch error, base pitch error, tooth profile error, tooth space runout, and tooth lead error (see FIG. 11).

Figure 12:
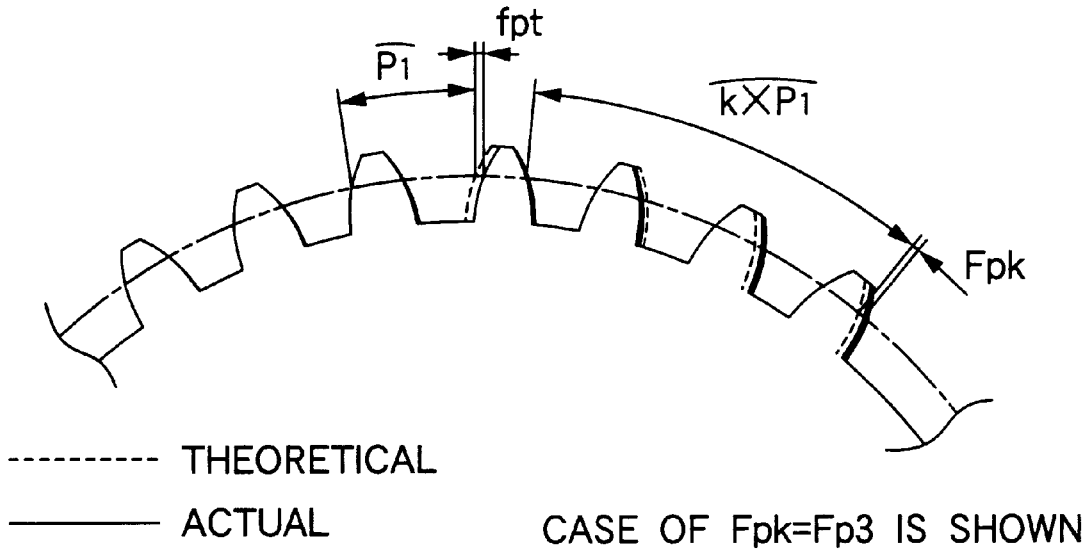
FIG. 12 is an explanatory view showing an error of a gear.

Here, the single pitch error is, as shown in FIG. 12, a difference between an actual pitch and a correct pitch on a pitch circle of adjacent teeth. The pitch variation is a difference between two adjacent pitches on a pitch circle. The cumulative pitch error is a difference between a sum of actual pitches on a pitch circle between arbitrary two teeth and a correct value. The base pitch error is a difference between an actual dimension of a transverse base pitch and a theoretical value. The tooth profile error is, as shown in FIG. 10, a sum of a positive (+) side error and a negative (−) side error in a tooth profile inspection range obtained when a correct involute passing through an intersection point between an actual tooth profile and a pitch circle is made a base and measurement is made in a direction vertical to this. The tooth space runout is a maximum difference at a radial direction position when a contact piece such as a ball or a pin is brought into contact with both side tooth surfaces of a tooth space near a pitch circle. The tooth lead error is, as shown in FIG. 11, a difference between an actual tooth trace curved line corresponding to a tooth width in a necessary inspection range on a pitch cylinder and a theoretical curved line (see JIS B 1702).

Then, in the photoreceptor gears 98, 99, 100 and 101 used for rotating and driving the photosensitive drums 11, 12, 13 and 14 and made of helical gears, the present inventor earnestly studied the relation between the pitch error or the like of the helical gear experimentally formed for actually rotating and driving the photosensitive drums 11, 12, 13 and 14 and the variation of rotation speed of the photosensitive drums 11, 12, 13 and 14, and found the following.

FIGS. 13A to 13C and FIGS. 18, 19 and 20 set forth later show measurement data of radial composite deviation, measurement data of tooth space runout, and measurement data of cumulative pitch error of the intermediate transfer gears 96 and 97 made of experimentally formed helical gears for rotating and driving the first and the second intermediate transfer drums 51 and 52, similarly to the photosensitive drums 11, 12,13 and 14.

Figure 26:
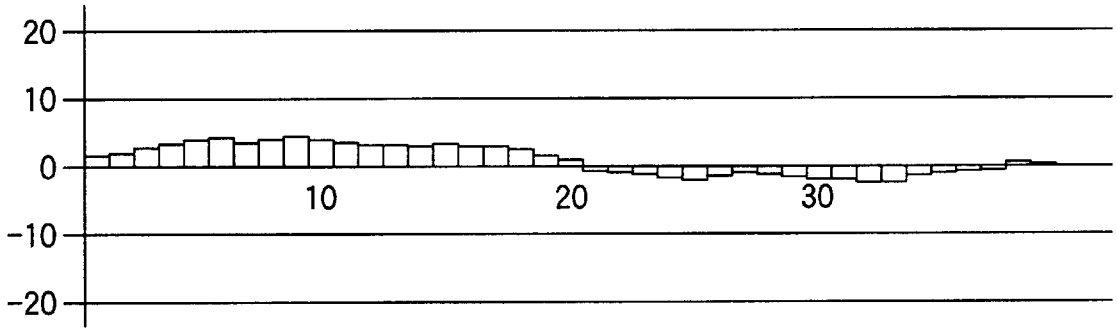
FIG. 26 is a graph showing measurement data of cumulative pitch error of an experimentally formed photoreceptor gear.

Incidentally, as described later, although the present invention regulates the relation between the phase of eccentricity of, for example, the photosensitive drum 11, 12, 13 or 14 as the rotation member and the phase of cumulative pitch error in the rotation direction of the photoreceptor gear for driving the photosensitive drum 11, 12, 13 or 14, the photoreceptor gear 98, 99, 100 or 101 has a small diameter and the number of teeth is also small. Thus, here, there are shown measurement data of radial composite deviation, measurement data of tooth space runout, and measurement data of cumulative pitch error of the intermediate transfer gears 96 and 97 each made of a helical gear and having a number of teeth. However, also in the photoreceptor gears 98, 99, 100 and 101, the result of measurement of cumulative pitch error in the rotation direction is as shown in FIG. 26, and similarly to the intermediate transfer gears 96 and 97 shown in FIG. 13A, it has a phase indicating a maximum value and a minimum value per rotation.

Figure 13A:
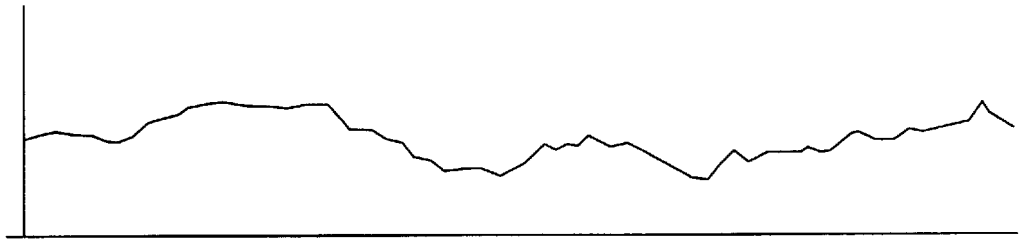
FIGS. 13A to 13C are graphs showing measurement data of radial composite deviation, tooth space runout, and cumulative pitch error of experimentally formed gears.
Figure 13B:
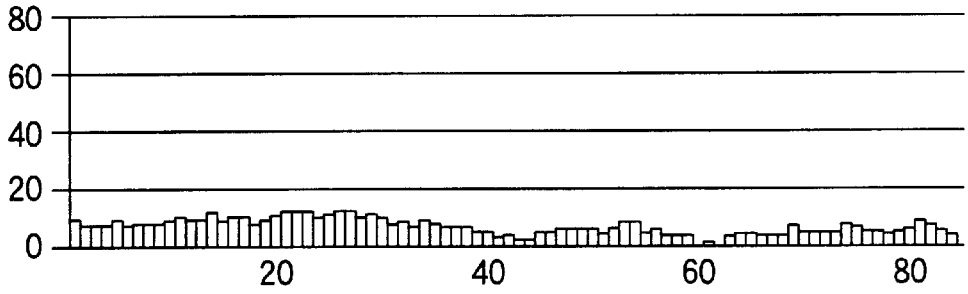
Figure 13C:
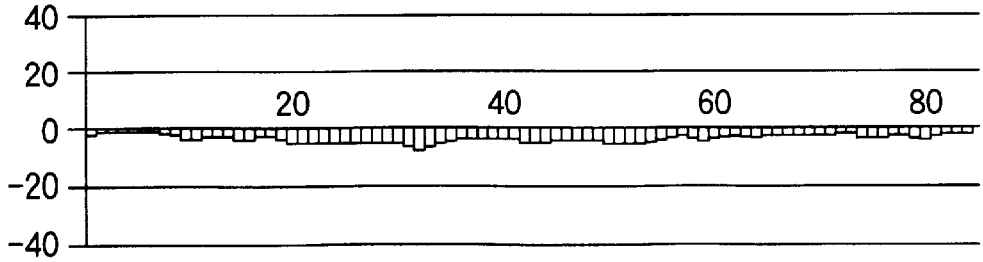

That is, FIG. 13A shows the measurement data of radial composite deviation of the intermediate transfer gears 96, 96 made of the helical gears experimentally formed for rotating and driving the first and the second intermediate transfer drums 51 and 52, FIG. 13B shows the measurement data of tooth space runout of the intermediate transfer gears 96, 96 made of the helical gears experimentally formed for rotating and driving the first and the second intermediate transfer drums 51 and 52, and FIG. 13C shows the measurement data of cumulated pitch error of the intermediate transfer gears 96 and 96 made of the helical gears experimentally formed for rotating and driving the first and the second intermediate transfer drums 51 and 52. Here, a radial composite deviation test is such that a master gear and a helical gear to be tested are rotated in a state where the master gear is urged against the helical gear to be tested so that both the tooth surfaces are engaged, and a variation between the rotating shafts of both the gears is measured by a variation detector.

As is understood from FIGS. 13A to 13C, it is understood that when a measurement start point of the experimentally formed helical gear is made a basis, the phase of the measurement data of the radial composite deviation and the phase of the measurement data of the tooth space runout are coincident with each other. Besides, it is understood that at the position where the measurement data of the radial composite deviation becomes maximum, the measurement data of the tooth space runout also becomes maximum, and at the position where the measurement data of the radial composite deviation becomes minimum, the measurement data of the tooth space runout also becomes minimum.

On the other hand, as shown in FIG. 13C, it is understood that the phase of the measurement data of the cumulative pitch error of the experimentally formed helical gear is different from the measurement data of the radial composite deviation and the measurement data of the tooth space runout.

Further, as a result of a series of studies of the present inventor, it has been found that the measurement data of the cumulative pitch error of the experimentally formed helical gear roughly corresponds to the variation of rotation speed (angular speed) of the photosensitive drum 11, 12, 13 or 14 rotated and driven by the helical gear.

Figure 14A:
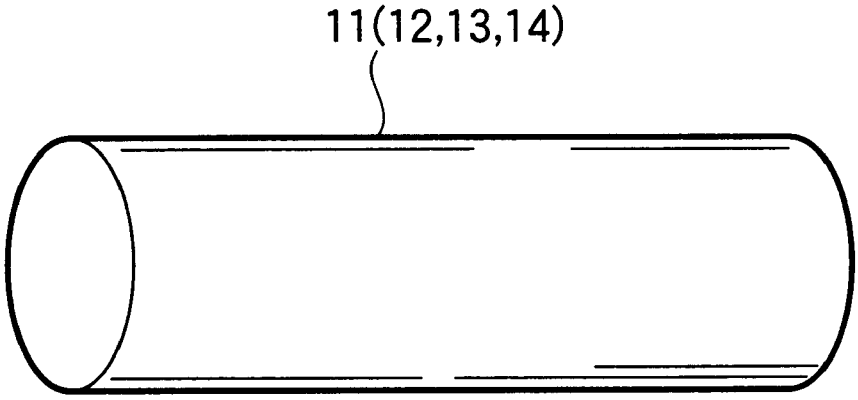
FIGS. 14A and 14B are schematic views showing eccentricity of a photosensitive drum, respectively.
Figure 14B:
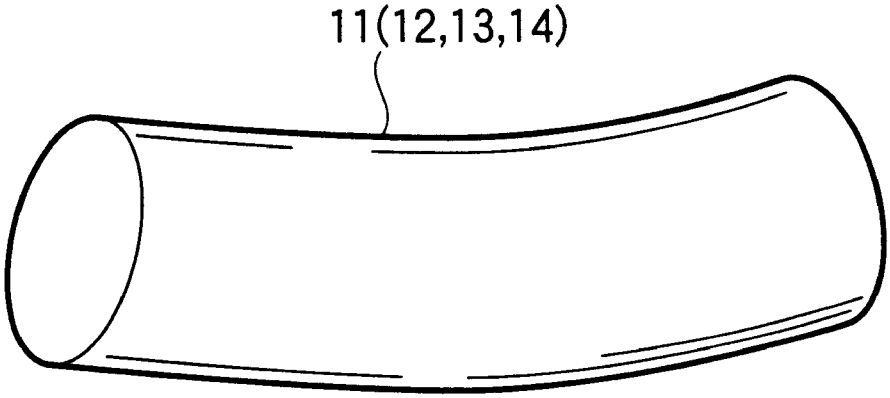

The photosensitive drums 11, 12, 13 and 14 themselves rotated and driven by the photoreceptor gears 98, 99, 100 and 101 made of the helical gears do not necessarily have ideal cylindrical shapes as shown in FIG. 14A, and it is known that as shown in FIG. 14B, the center portion of the photosensitive drum 11, 12, 13 or 14 in the axial direction has eccentricity from the center axis, so-called "run out". Incidentally, it has been found that the sectional shape of the photosensitive drum 11, 12, 13 or 14 has a dimension error of about 2 μm in the vertical and horizontal and is a substantially true circle.

Then, the present inventor obtained the eccentricity of the actual photosensitive drum 11, 12, 13 or 14 in the axial direction by measuring the outer diameter of the photosensitive drum 11, 12, 13 or 14 in the axial direction at three places of both the right and left end portions and the center portion.

Figure 15:
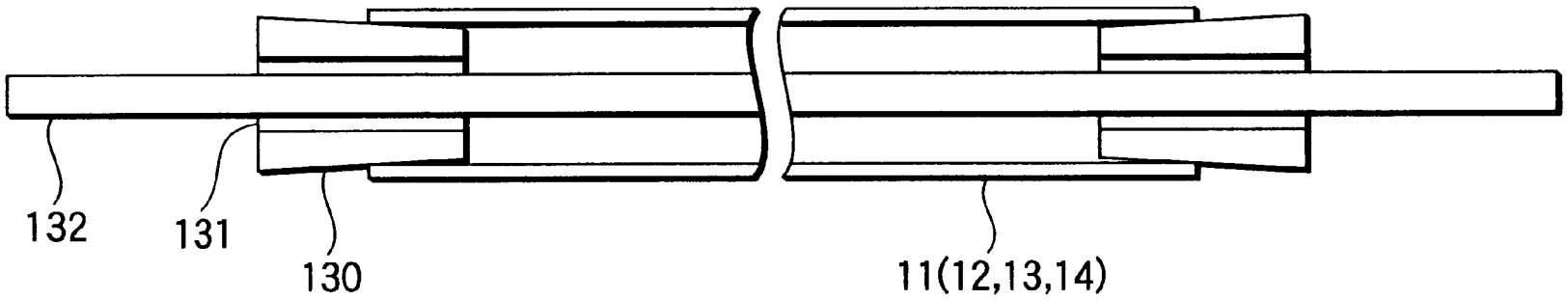
FIG. 15 is a sectional view showing a tool for measuring eccentricity of a photosensitive drum.
Figure 16:
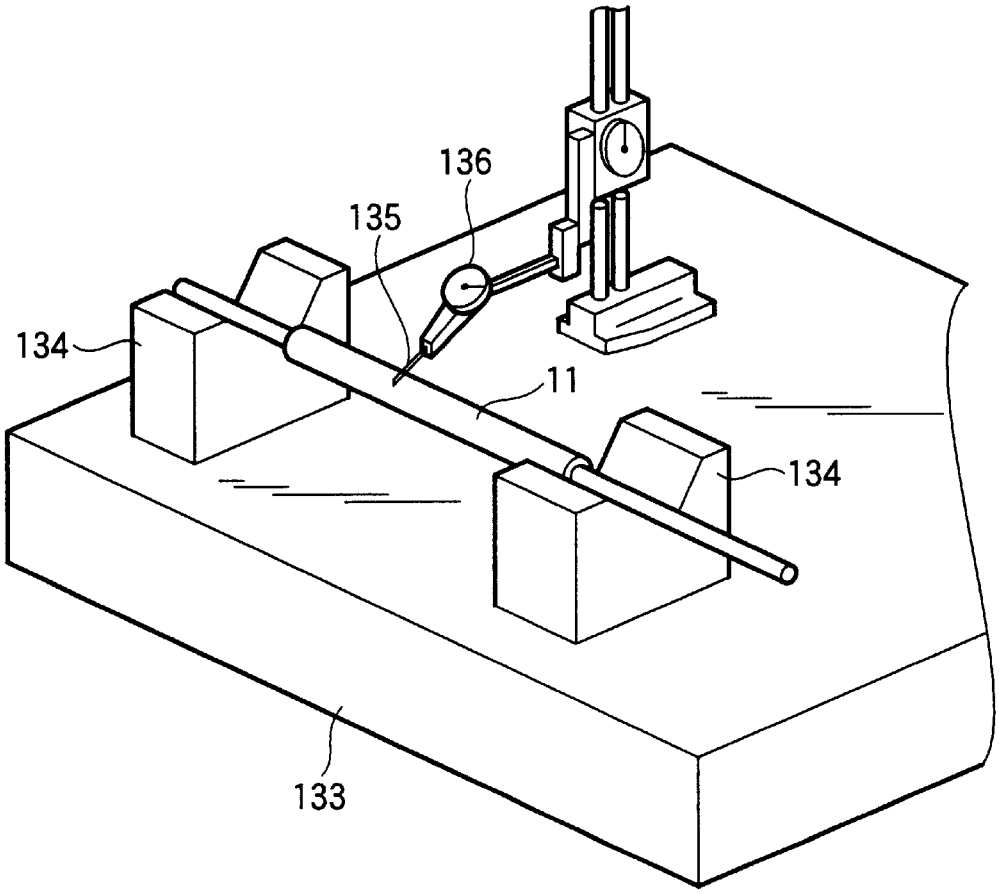
FIG. 16 is a perspective explanatory view showing a measuring method of eccentricity of a photosensitive drum.
Figure 18:
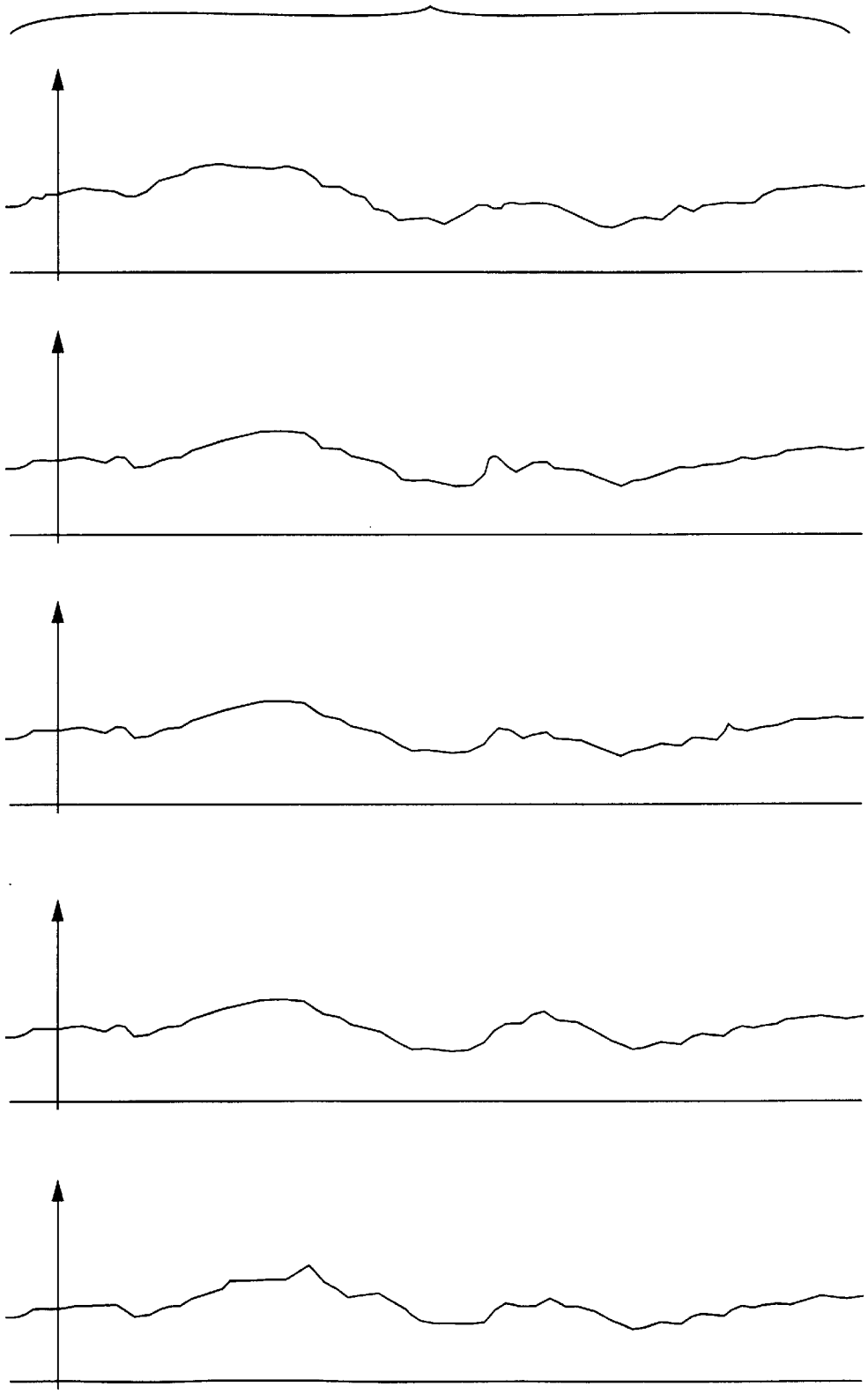
FIG. 18 is a graph showing measurement data of radial composite deviation of experimentally formed different gears.
Figure 19:
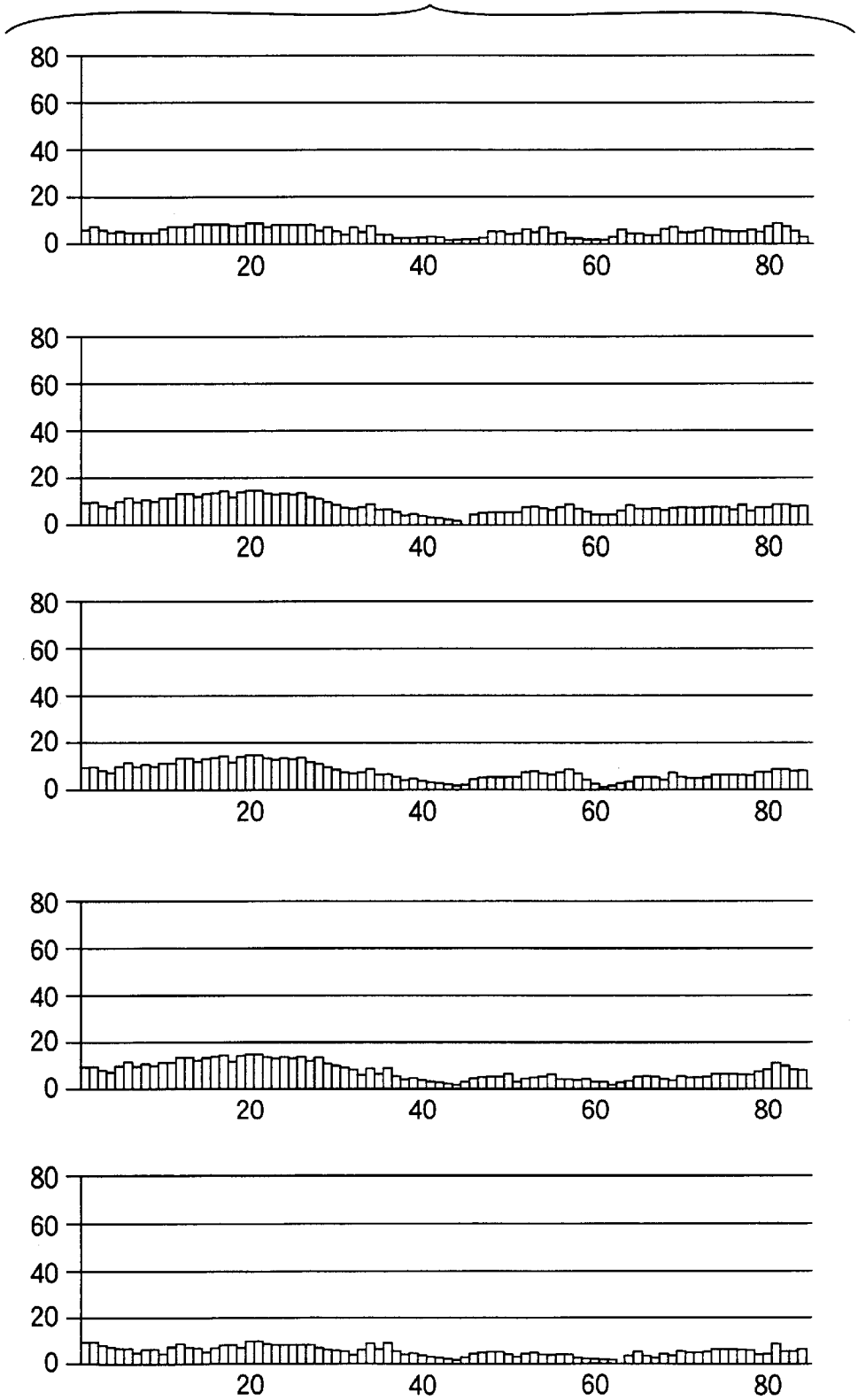
FIG. 19 is a graph showing measurement data of tooth space runout of experimentally formed different gears.
Figure 20:
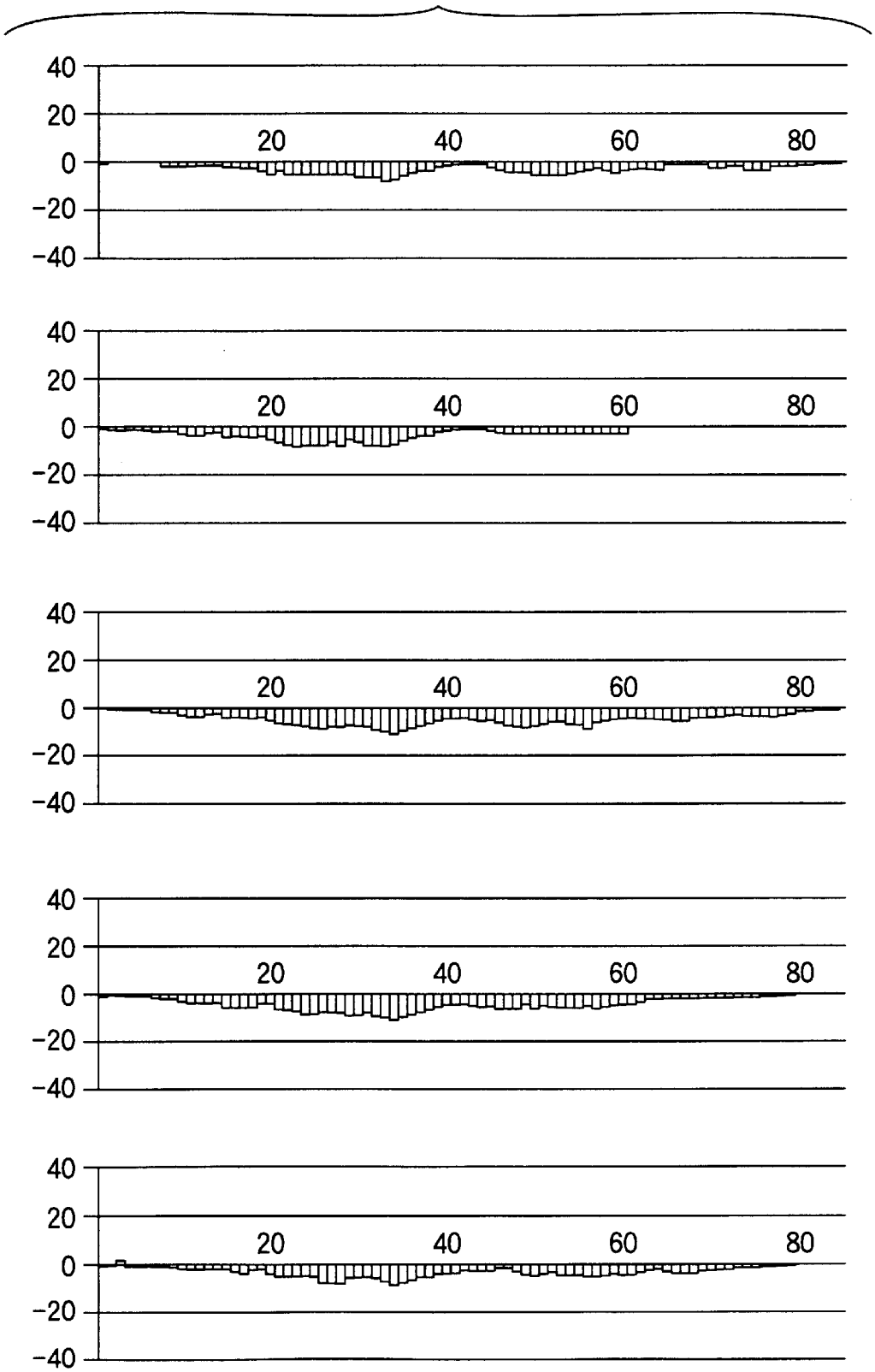
FIG. 20 is a graph showing measurement data of cumulative pitch error of experimentally formed different gears.

As shown in FIGS. 15 and 16, measurement of the eccentricity amount of the photosensitive drum 11, 12, 13 or 14 in the axial direction is carried out such that taper-shaped high precision metallic tools 130 are fitted to both end portions of the photosensitive drum 11, 12, 13 or 14, and in the state where a shaft 132 is inserted in bearings 131 fitted to the insides of the taper-shaped high precision metallic tools 130, both ends of the shaft 132 are supported by V blocks 134 disposed on a measurement bench 133, and a position of a gauge head 135 brought into contact with the surface of the photosensitive drum 11, 12, 13 or 14 is measured by a fine measuring instrument 136.

FIG. 17 is a graph showing results of measurement in which the outer diameter of the photosensitive drum 11, 12, 13 or 14 in the axial direction is measured using 49 experimentally formed photosensitive drums.

As is understood from FIG. 17, the outer diameter of the photosensitive drum 11, 12, 13 or 14 fluctuated in the axial direction, and there was a large fluctuation of up to 22 μm in the outer diameter.

As described above, if the photosensitive drum 11, 12, 13 or 14 has the run out in the outer diameter, even if the photosensitive drum 11, 12, 13 or 14 is rotated and driven at a definite angular speed, at a portion where the outer diameter of the photosensitive drum 11, 12, 13 or 14 is large, the surface speed becomes large by that, and at a portion where the outer diameter of the photosensitive drum 11, 12, 13 or 14 is small, the surface speed becomes small by that. As a result, a speed variation per rotation caused by the run out of the photosensitive drum 11, 12, 13 or 14 is generated.

On the other hand, if the photoreceptor gear 98, 99, 100 or 101 made of the helical gear for rotating and driving the photosensitive drum 11, 12, 13 or 14 has an error in precision, a speed variation per rotation is generated in the rotation of the photosensitive drum 11, 12, 13 or 14.

Then, the present inventor has concluded that among errors of the photoreceptor gear 98, 99, 100 or 101 made of the helical gear, in view of the fact that the cumulative pitch error directly corresponds to the speed variation, the rotation variation of the photosensitive drum 11, 12, 13 or 14 can be suppressed by setting the phase of the cumulative pitch error of the photoreceptor gear 98, 99, 100 or 101 and the phase of the run out of the photosensitive drum 11, 12, 13 or 14 so that they satisfy a predetermined relation.

Then, in this embodiment of the present invention, in a rotation member driving device for rotating and driving a rotation member for image formation by a gear, the relation between the phase of the eccentricity of the rotation member and the phase of the cumulative pitch error of the gear attached to the rotation member to drive the rotation member is set to restrain the variation of the surface speed due to the eccentricity of the rotation member from appearing on an image.

Besides, in the embodiment of the present invention, setting is made such that when the position where the eccentricity of the rotation member is relatively large is moved to an image formation position concerning the rotation member for image formation, at the engagement position of the gear attached to the rotation member, the cumulative pitch error of the rotation member gear becomes relatively small.

More desirably, in the embodiment of the present invention, setting is made such that when a phase neighborhood where the eccentricity of the rotation member becomes approximately maximum is moved to the image formation position concerning the rotation member for image formation, the engagement position of the gear attached to the rotation member becomes a phase neighborhood where the cumulative pitch error of the rotation member gear becomes approximately minimum.

Still desirably, the embodiment of the present invention is structured such that marks are respectively attached to a position where the eccentricity of the rotation member becomes maximum and a position where the cumulative pitch error of the rotation member gear becomes minimum, and on the basis of the marks, a gear is attached to the rotation member.

That is, in this embodiment, as shown in FIGS. 13A to 13C, the cumulative pitch error of the photoreceptor gear 98, 99, 100 or 101 made of the helical gear is measured over one rotation of the photoreceptor gear 98, 99, 100 or 101, and at least one of the maximum position and the minimum position of the phase of the cumulative pitch error is obtained.

At that time, since the photoreceptor gear 98, 99, 100 or 101 made of the helical gear is manufactured by injection molding using synthetic resin, or the like, the plural photoreceptor gears 98, 99, 100 and 101 manufactured by the same shaping dies have, as shown in FIGS. 13A to 13C and FIGS. 18 to 20, the same characteristics in the measurement data of the radial composite deviation, the measurement data of the tooth space runout, and the measurement data of the cumulative pitch error, and the maximum position and the minimum position of the phase of the cumulative pitch error become substantially the same in all the photoreceptor gears 98, 99, 100 and 101.

Thus, when the photoreceptor gears 98, 99, 100 and 101 are manufactured by the injection molding using synthetic resin, or the like, by providing a mark made of a projection or the like indicating the maximum position and/or minimum position of the phase of the cumulative pitch error, it becomes possible to automatically discriminate the maximum position and/or the minimum position of the phase of the cumulative pitch error.

As shown in FIG. 8A, the mark indicating the maximum position and/or the minimum position of the phase of the cumulative pitch error of the photoreceptor gear 98, 99, 100 or 101 is formed by, for example, providing a protrusion 140 at an inside end portion of the outside cylindrical portion 112 and providing a mark 141 or the like at an outside end portion of the outside cylindrical portion 112. The protrusion 140 provided at the inside end portion of the outside cylindrical portion 112 is for automatically discriminating the maximum position and/or the minimum position of the phase of the cumulative pitch error of the photoreceptor gear 98, 99, 100 or 101 when the photosensitive drum 11, 12, 13 or 14 is automatically assembled.

Besides, in the photosensitive drum 11, 12, 13 or 14, the run out in the axial direction of the photosensitive drum 11, 12, 13 or 14 is measured by the method shown in FIG. 16 or the like, and a mark is provided at the position where the phase of the run out of the photosensitive drum 11, 12, 13 or 14 in the axial direction is maximum. Incidentally, as this mark, marking by an ink jet or a scratching line given to the end portion of a drum or the outside of printing range is used.

Figure 1A:
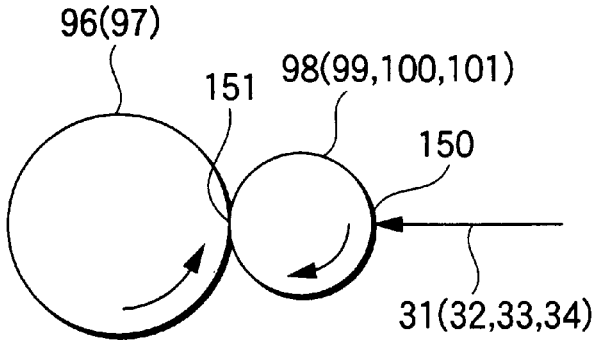
FIGS. 1A and 1B are a side structural view and a perspective structural view showing a main portion of a color printer as an image forming apparatus to which a rotation member driving device according to a first embodiment of the present invention is applied.
Figure 1B:
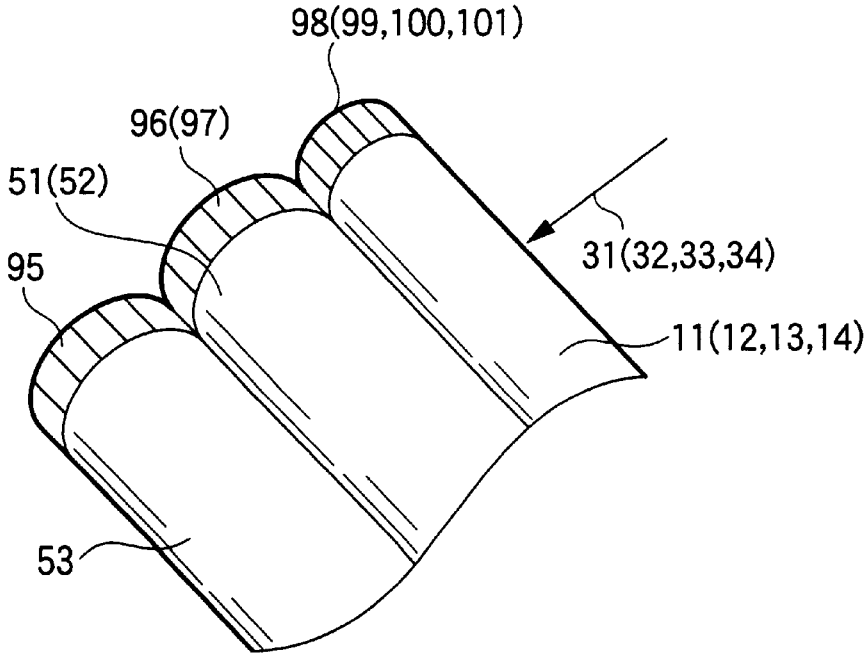

As shown in FIG. 17, the photosensitive drum 11, 12, 13 or 14 is set such that when the gear member 111 with the integrally formed photoreceptor gear 98, 99, 100 or 101 is attached to one end portion of the cylinder 110 by a method of press insertion or the like, as shown in FIGS. 1A and 1B, when the position where the eccentricity of the photosensitive drum 11, 12, 13 or 14 becomes maximum is moved to an image exposure position 150, at a position 151 where the photoreceptor gear 98, 99, 100 or 101 attached to the photosensitive drum 11, 12, 13 or 14 engages with the second or third intermediate transfer gear 96 or 97, the cumulative pitch error of the photoreceptor gear 98, 99, 100 or 101 becomes minimum.

Incidentally, in FIGS. 1A and 1B, for convenience, the image exposure position 150 of the photosensitive drum 11, 12, 13 or 14 and the position 151 where the photoreceptor gear 98, 99, 100 or 101 attached to the photosensitive drum 11, 12, 13 or 14 is engaged with the second or third intermediate transfer gear 96 or 97 are shown as positions differing by 180 degrees. However, in an actual full-color printer, as shown in FIG. 2 and FIG. 5, the positions of both are not necessarily set to be the positions differing by 180 degrees, but as described above, setting is made such that when the position where the eccentricity of the photosensitive drum 11, 12, 13 or 14 becomes maximum is moved to the image exposure position 150, at the position where the photoreceptor gear 98, 99, 100 or 101 attached to the photosensitive drum 11, 12, 13 or 14 is engaged with the second or third intermediate transfer gear 96 or 97, there appears a position where the cumulative pitch error of the photoreceptor gear 98, 99, 100 or 101 becomes minimum.

In the above structure, in the tandem full-color printer of this embodiment, as described below, without enlarging the device and increasing the cost, by reducing the speed variation generated during one rotation of the rotation member such as the image holding member or intermediate transfer member, the distortion and out of color registration of an image formed on or transferred onto the rotation member such as the image holding member or the intermediate transfer member are reduced, and a high quality image can be formed.

That is, in the tandem full-color printer of this embodiment, as shown in FIG. 2, toner images of respective colors of yellow, magenta, cyan and black are formed at predetermined timing on the respective photosensitive drums 11, 12, 13 and 14 for yellow, magenta, cyan and black. Among the respective photosensitive drums 11, 12, 13 and 14, the toner images of yellow and magenta formed on the photosensitive drums 11 and 12 are primary transferred onto the first intermediate transfer drum 51 in order of magenta and yellow. The toner images of cyan and black formed on the photosensitive drums 13 and 14 are primary transferred onto the second intermediate transfer drum 52 in order of black and cyan.

Thereafter, the toner images of magenta and yellow primary transferred onto the first intermediate transfer drum 51 and the toner images of black and cyan primary transferred onto the second intermediate transfer drum 52 are collectively transferred onto the third intermediate transfer drum 53 in the state where they are overlapped.

The toner images of magenta, yellow, black and cyan transferred onto the third intermediate transfer drum 53 in the overlap state are tertiary transferred onto the recording sheet P collectively by the final transfer roll 60, and the recording sheet P on which the toner images of magenta, yellow, black and cyan are transferred is transported in the direction of the arrow and is subjected to a fixation processing by the fixing unit 70, so that a full-color image is formed.

In this embodiment, as shown in FIG. 2, the images of the respective colors of yellow, magenta, cyan and black are exposed onto the respective photosensitive drums 11, 12, 13 and 14, the electrostatic latent images corresponding to the respective colors are formed, and the electrostatic latent images formed on the respective photosensitive drums 11, 12, 13 and 14 are developed by the development devices 41, 42, 43 and 44 for the respective colors of yellow, magenta, cyan and black, so that the toner images of the respective colors of yellow, magenta, cyan and black are formed.

Figure 21A:
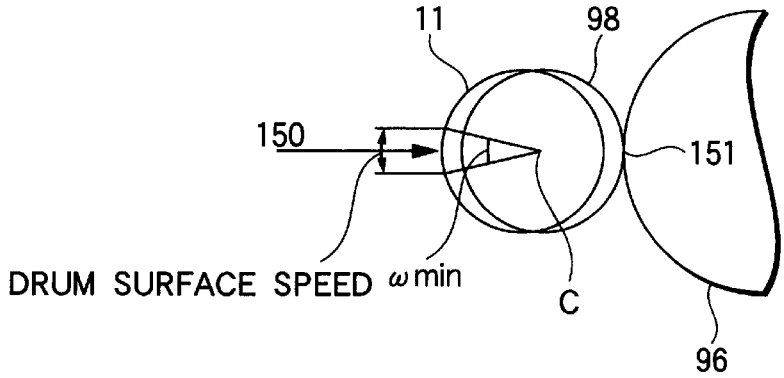
FIGS. 21A and 21B are an explanatory view and a graph showing the operation of the color printer as the image forming apparatus to which the rotation member driving device according to the first embodiment of the present invention is applied.
Figure 21B:
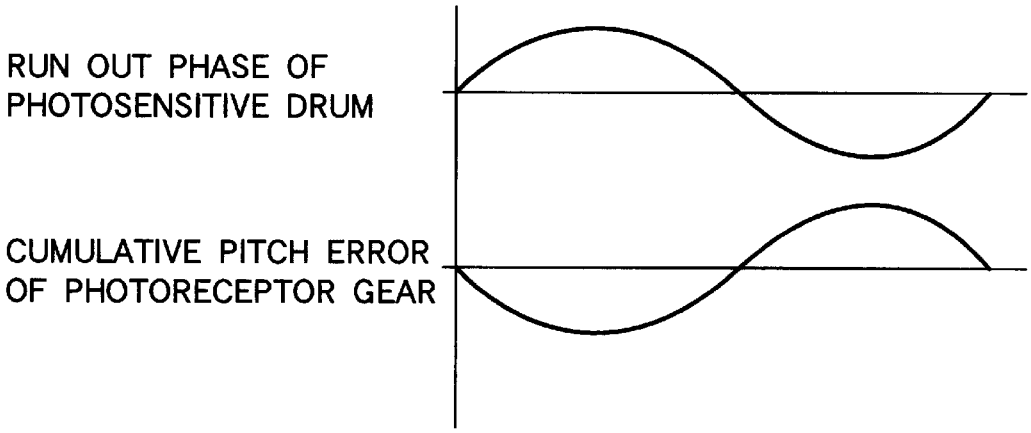

At that time, in this embodiment, as shown in FIGS. 1A to 1B, setting is made such that when the position where the eccentricity of the photosensitive drum 11, 12, 13 or 14 becomes maximum is moved to the image exposure position 150, the position where the cumulative pitch error of the photoreceptor gear 98, 99, 100 or 101 becomes minimum appears at the position 151 where the photoreceptor gear 98, 99, 100 or 101 attached to the photosensitive drum 11, 12, 13 or 14 is engaged with the second or third intermediate transfer member gear 96 and 97. Thus, in the tandem full-color printer, even in the case where the photosensitive drum 11, 12, 13 or 14 has eccentricity in the axial direction, and the photoreceptor gear 98, 99, 100 or 101 for driving the photosensitive drum 11, 12, 13 or 14 has an error in precision, as shown in FIGS. 21A and 21B, when the position where the eccentricity of the photosensitive drum 11, 12, 13 or 14 becomes maximum is moved to the image exposure position 150, the position where the cumulative pitch error of the photoreceptor gear 98, 99, 100 or 101 becomes minimum appears at the position 151 where the photoreceptor gear 98, 99, 100 or 101 attached to the photosensitive drum 11, 12, 13 or 14 is engaged with the second or third intermediate transfer gear 96 or 97.

Accordingly, when the position where the eccentricity of the photosensitive drum 11, 12, 13 or 14 becomes maximum is moved to the image exposure position 150, since the eccentricity of the photosensitive drum 11, 12, 13 or 14 is maximum, the radius from the rotation center C of the photosensitive drum 11, 12, 13 or 14 to the image exposure position 150 becomes maximum. At this time, since the photoreceptor gear 98, 99, 100 or 101 for rotating and driving the photosensitive drum 11, 12, 13 or 14 is set so that the cumulative pitch error of the photoreceptor gear 98, 99, 100 or 101 becomes minimum at the engagement position 151, the angular speed of the photoreceptor gear 98, 99, 100 or 101 for rotating and driving the photosensitive drum 11, 12, 13 or 14 also becomes minimum similarly to the cumulative pitch error. As a result, when the position where the eccentricity of the photosensitive drum 11, 12, 13 or 14 is maximum and the radius from the rotation center C of the photosensitive drum 11, 12, 13 or 14 to the image exposure position 150 becomes maximum is moved to the image exposure position 150, the angular speed of the photoreceptor gear 98, 99, 100 or 101 for rotating and driving the photosensitive drum 11, 12, 13 or 14 becomes minimum, so that the moving speed of the surface at the position where the eccentricity of the photosensitive drum 11, 12, 13 or 14 is maximum is restrained from becoming larger than a set value, and becomes a value approximately close to the set value.

Figure 22:
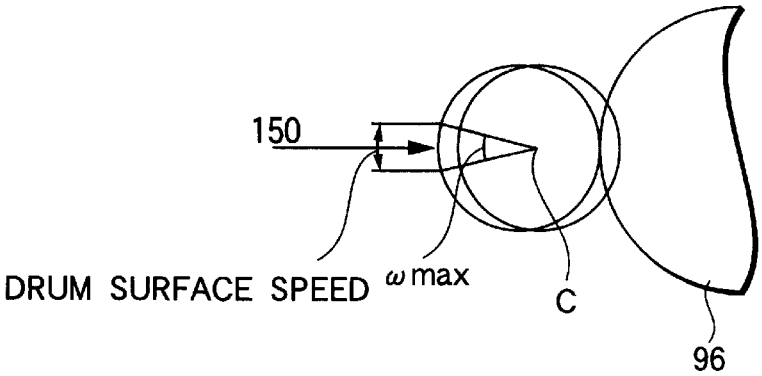
FIG. 22 is an explanatory view showing the operation of the color printer as the image forming apparatus to which the rotation member driving device according to the first embodiment of the present invention is applied.

On the other hand, when the position where the eccentricity of the photosensitive drum 11, 12, 13 or 14 becomes minimum is moved to the image exposure position 150, as shown in FIG. 22, since the eccentricity of the photosensitive drum 11, 12, 13 or 14 is minimum, the radius from the rotation center C of the photosensitive drum 11, 12, 13 or 14 to the image exposure position 150 becomes minimum. At this time, in the photoreceptor gear 98, 99, 100 or 101 for rotating and driving the photosensitive drum 11, 12, 13 or 14, since the cumulative pitch error of the photoreceptor gear 98, 99, 100 or 101 becomes approximately maximum at the engagement position 151, the angular speed of the photoreceptor gear 98, 99, 100 or 101 for rotating and driving the photosensitive drum 11, 12, 13 or 14 also becomes maximum similarly to the cumulative pitch error. As a result, when the position where the eccentricity of the photosensitive drum 11, 12, 13 or 14 is minimum and the radius from the rotation center C of the photosensitive drum 11, 12, 13 or 14 to the image exposure position 150 becomes minimum is moved to the image exposure position 150, the angular speed of the photoreceptor gear 98, 99, 100 or 101 for rotating and driving the photosensitive drum 11, 12, 13 or 14 becomes approximately maximum, so that the moving speed of the surface at the position where the eccentricity of the photosensitive drum 11, 12, 13 or 14 is minimum is restrained from becoming smaller than a set value and becomes approximately close to the set value.

Like this, in the embodiment, setting is made such that when the position where the eccentricity of the photosensitive drum 11, 12, 13 or 14 becomes maximum is moved to the image exposure position 150, the position 151 where the cumulative pitch error of the photoreceptor gear 98, 99, 100 or 101 becomes minimum appears at the position where the photoreceptor gear 98, 99, 100 or 101 attached to the photosensitive drum 11, 12, 13 or 14 is engaged with the second or third intermediate transfer gear 96 or 97. As a result, the speed variation resulting from the eccentricity of the photosensitive drum 11, 12, 13 or 14 can be restrained by the speed variation due to the error in manufacture of the photoreceptor gear 98, 99, 100 or 101, the rotation speed of the photosensitive drum 11, 12, 13 or 14 becomes a value substantially equal to the set value, and it becomes possible to form an image having a small registration error when the image is formed by carrying out image exposure to the surface of the photosensitive drum 11, 12, 13 or 14.

Accordingly, in the above embodiment, by merely carrying out setting such that the position where the eccentricity of the photosensitive drum 11, 12, 13 or 14 becomes maximum and the position where the cumulative pitch error of the photoreceptor gear 98, 99, 100 or 101 becomes minimum satisfy the predetermined relation, the speed variation generated during one rotation of the photosensitive drum 11, 12, 13 or 14 is decreased without enlarging the device and increasing the cost, so that it becomes possible to reduce the distortion and out of color registration of the image formed on the photosensitive drum 11, 12, 13 or 14 and to form the high quality image.

Incidentally, with respect to the numerical relation between the run out due to the eccentricity of the photosensitive drum 11, 12, 13 or 14 and the cumulative pitch error of the photoreceptor gear 98, 99, 100 or 101, it is desirable that the difference between both is 30 $\mu$m or less. The reason is that if the difference between the run out due to the eccentricity of the photosensitive drum 11, 12, 13 or 14 and the cumulative pitch error of the photoreceptor gear 98, 99, 100 or 101 exceeds 30 $\mu$m, it is expected that it becomes difficult to correct the run out due to the eccentricity of the photosensitive drum 11, 12, 13 or 14 by using the cumulative pitch error of the photoreceptor gear 98, 99, 100 or 101, and the image quality is lowered.

Figure 23:
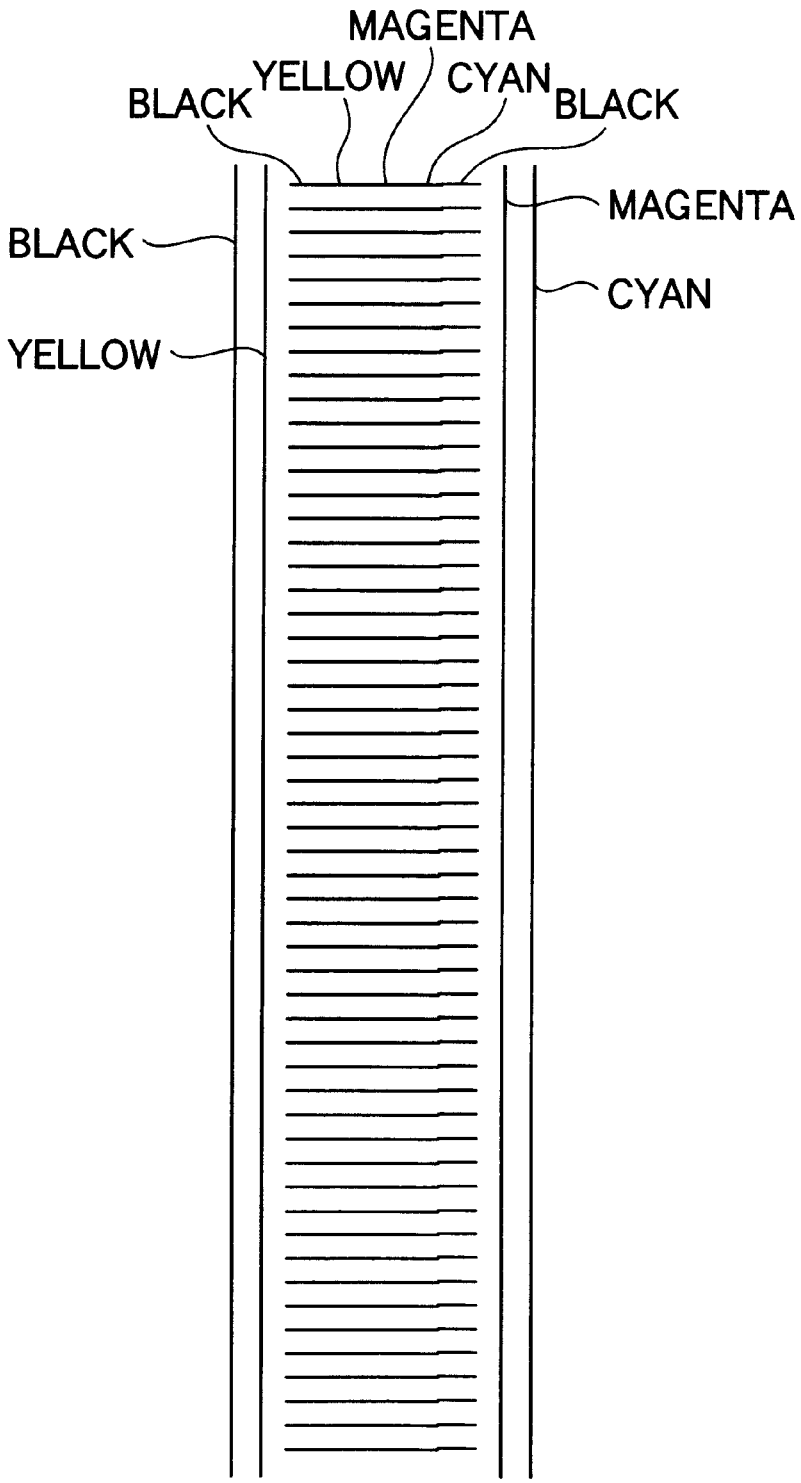
FIG. 23 is an explanatory view showing an image pattern transferred onto a sheet.

Next, in order to confirm the effects of the present invention described in this embodiment, the present inventor carried out an experiment such that a full-color printer as shown in FIG. 2 was experimentally formed, and by using the full-color printer, as shown in FIG. 23, short thin lines of respective colors of yellow, magenta, cyan and black were formed linearly in the horizontal direction at both end portions and the center portion of an A4 size sheet at define intervals in the width direction, and short thin lines of the respective colors were formed in the vertical direction (rotation direction of a photosensitive drum) of the A4 size sheet, and intervals of the short thin lines of the respective colors of yellow, magenta, cyan and black in the vertical direction (rotation direction of the photosensitive drum) were obtained by measuring barycentric positions of the short thin lines of the respective colors by a densitometer.

Figure 24:
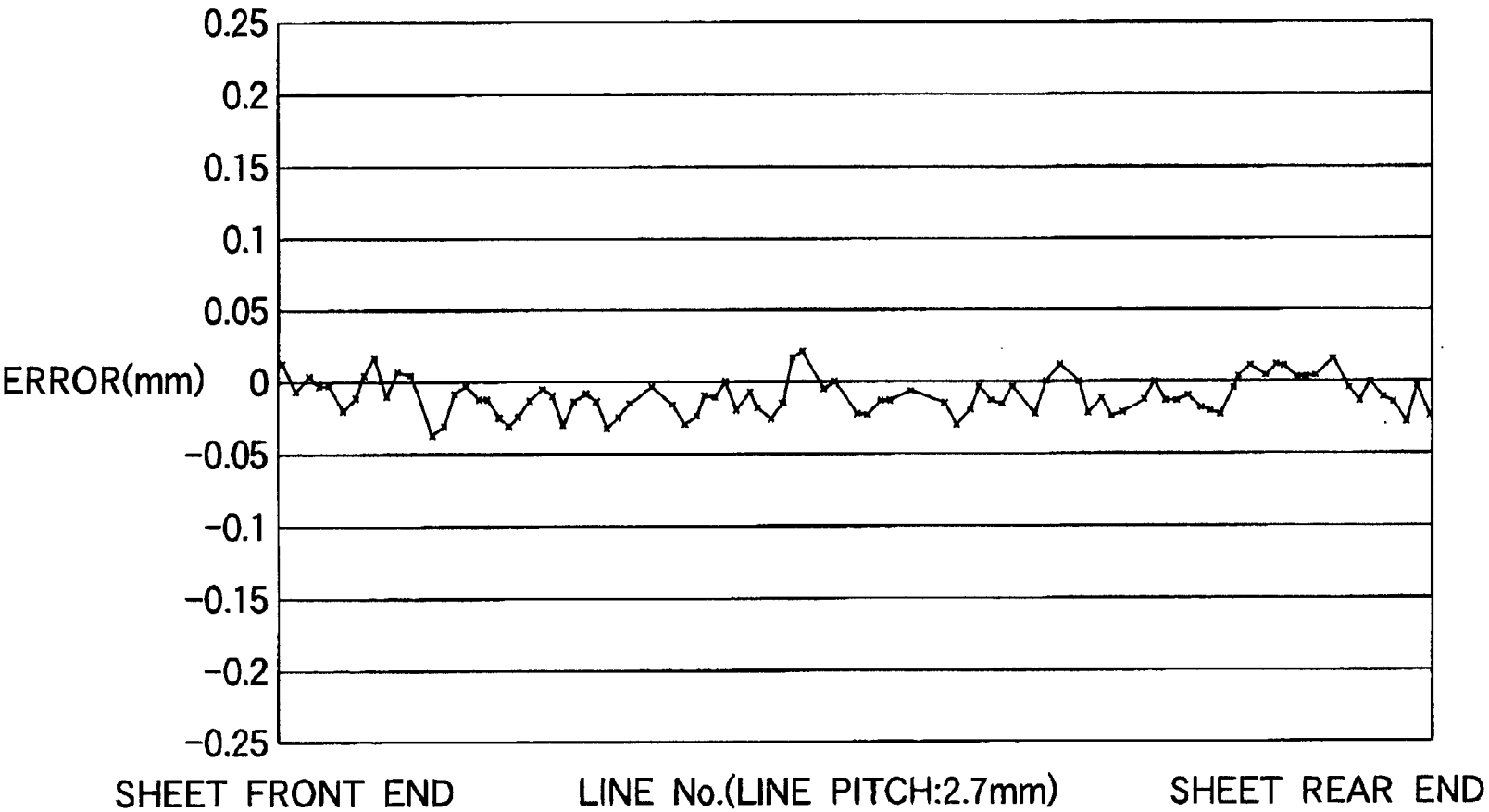
FIG. 24 is a graph showing the position shift amount of a black linear image with respect to a yellow linear image according to a printer to which the present invention is applied.

FIG. 24 shows the result of the experiment.

As a comparable example, a similar experiment was carried out using a conventional full-color printer to which the present invention was not applied.

Figure 25:
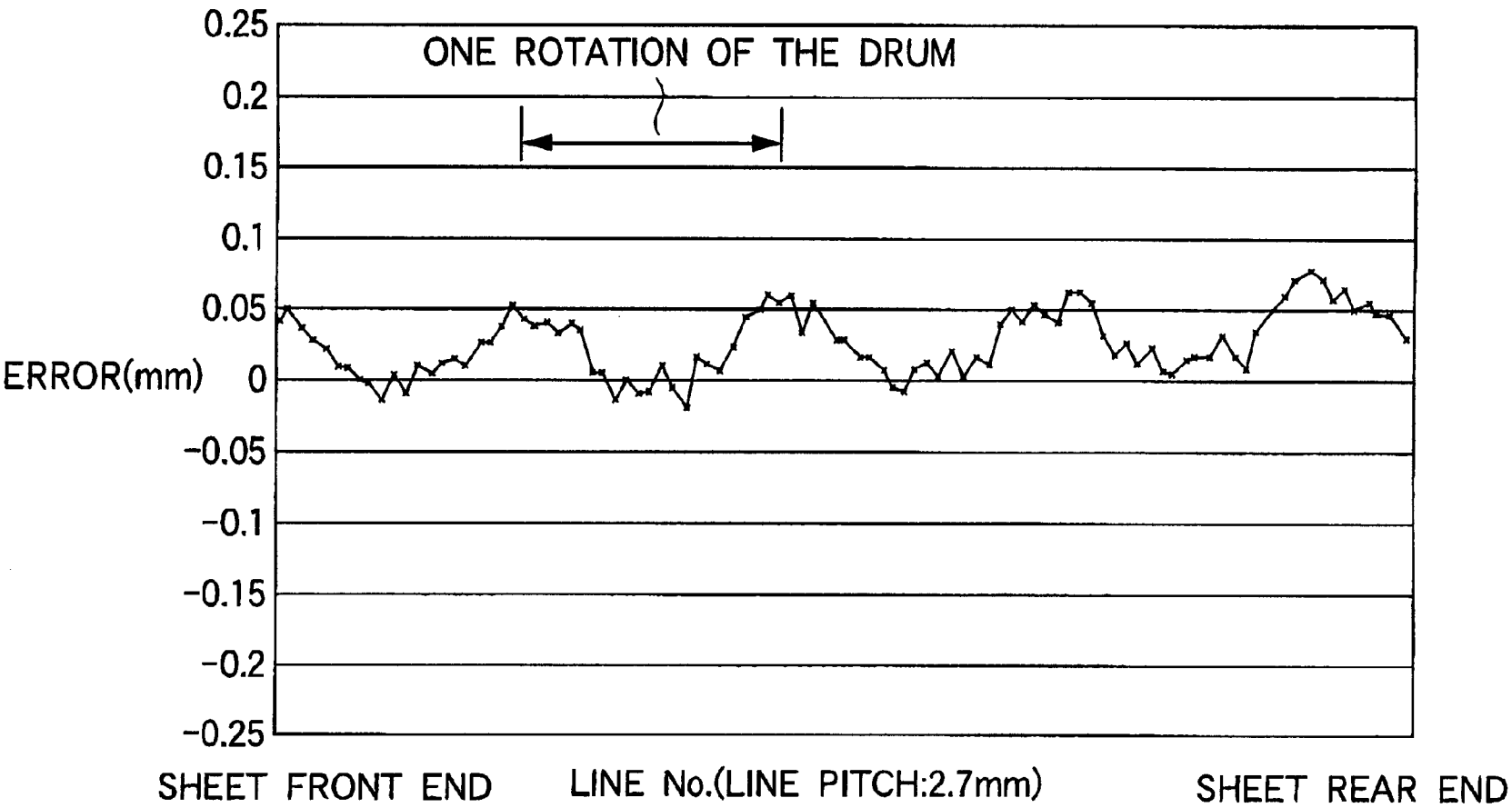
FIG. 25 is a graph showing the position shift amount of a black linear image with respect to a yellow linear image according to the prior art.

FIG. 25 shows the result of the comparative example.

As is apparent from FIG. 24 and FIG. 25, in the conventional full-color printer to which the present invention is not applied, in one rotation of the photosensitive drum, when the yellow thin line is made the basis, the distance between the yellow thin line and the black thin line periodically varies, and the variation amount is large. On the other hand, in the full-color printer to which the present invention is applied, it is seen that in one rotation of the photosensitive drum, when the yellow thin line is made the basis, the distance between the yellow thin line and the black thin line does not periodically vary, and the distance between the yellow thin line and the black thin line is a substantially constant small value.

Like this, it has been found that by applying the present invention, the speed variation resulting from the eccentricity of the photosensitive drum 11, 12, 13 or 14 can be restrained by the speed variation caused by the error in manufacture of the photoreceptor gear 98, 99, 100 or 101, and the distortion and out of color registration of the image formed on the photosensitive drum 11, 12, 13 or 14 are reduced and the high quality image is formed.

Incidentally, in the embodiment, although the description has been made on the case where the photosensitive drum is rotated and driven by the intermediate transfer gear at the position differing from the image exposure position by approximately 180 degrees, in the case where the photosensitive drum is rotated and driven by a not-shown gear from substantially the same direction as the image exposure position, if the maximum position of the run out of the photosensitive drum and the position where the cumulative pitch error of the photoreceptor gear becomes minimum are set to have the same phase, the same effect can be obtained.

Besides, in the embodiment, although the description has been made on the case where the eccentricity of the photosensitive drum in the axial direction is corrected, it is needless to say that the present invention can be similarly applied to the rotation driving of the intermediate transfer drum.

As described above, according to the present invention, it is possible to provide the rotation member driving device and the image forming apparatus using the same, in which without enlarging the device and increasing the cost, by reducing the speed variation generated during one rotation of the rotation member such as the image holding member or the intermediate transfer member, the distortion or out of color registration of the image formed on or transferred onto the rotation member such as the image holding member or the intermediate transfer member is reduced and the high quality image can be formed.

The entire disclosure of Japanese Patent Application No. 2000-208685 filed on Jul. 10, 2000 including specification, claims, drawings and abstract is incorporated herein by reference in its entirety.

What is claimed is:

1. An image forming apparatus for forming an image, comprising:

an image holding member having an eccentricity; and a gear attached to the image holding member for rotating thereof, wherein, when a position of the image holding member where the eccentricity is relatively large is moved to a position where exposure is performed, a cumulative pitch error of the gear in a direction of rotation becomes relatively small at an engaging position thereof.

2. An image forming apparatus for forming an image, comprising:

an image holding member that holds an image;

at least one intermediate transfer member having an eccentricity, onto which the image is transferred; and a gear attached to the intermediate transfer member for rotating thereof, wherein, when a position of the at least one intermediate transfer member where the eccentricity is relatively large is moved to an image transfer position, a cumulative pitch error of the gear in a direction of rotation becomes relatively small at an engaging position thereof.

3. An image forming apparatus for forming a color image by forming latent images respectively according to pieces of input information of plural colors, developing the latent images with toners of corresponding colors to obtain plural single-color toner images, and fixing the plural single-color toner images on a recording medium, the image forming apparatus comprising:

at least three image holding members on which latent images respectively corresponding to pieces of input information of plural colors are formed, and the latent images are developed with toners of corresponding colors to form plural single-color toner images;

a gear attached to each of the at least three image holding members for rotating thereof;

at least one intermediate transfer member which is disposed in contact with or close to the image holding member and to which the single-color toner images formed on the image holding members are transferred; and a final transfer rotation member for transferring the toner images transferred onto the at least one intermediate transfer member to a recording medium, wherein at least two image transferring cycles are performed, and when a position of the image holding member where eccentricity is relatively large is moved to a position where exposure is performed, a cumulative pitch error of the gear in a rotation direction becomes relatively small at an engagement position of the gear.

4. An image forming apparatus for forming a color image by forming latent images respectively according to pieces of input information of plural colors, developing the latent images with toners of corresponding colors to obtain plural single-color toner images, and fixing the plural single-color toner images on a recording medium, the image forming apparatus comprising:

a single image holding member on which latent images respectively corresponding to pieces of input information of plural colors are sequentially formed and the latent images are developed with toners of corresponding colors to form plural single-color toner images sequentially;

a gear attached to the image holding member for rotating thereof;

at least one intermediate transfer member which is disposed in contact with or close to the image holding member and to which the single-color toner images formed on the image holding member are transferred; and a final transfer rotation member for transferring the toner images transferred onto the at least one intermediate transfer member to a recording medium, wherein at least two image transferring cycles are performed, and when a position of the image holding member where eccentricity is relatively large is moved to a position where exposure is performed, a cumulative pitch error of the gear in a rotation direction becomes relatively small at an engagement position of the gear.

5. A rotation member driving device for rotating and driving a rotation member for forming an image, the device comprising:

a rotation member for forming an image, having an eccentricity; and a gear attached to the rotation member for rotating thereof, wherein a relation between a phase of the eccentricity of the rotation member and a phase of a cumulative pitch error in a direction of rotation of the gear is set so that a variation of a surface speed of the rotation member due to the eccentricity thereof is restrained from appearing on an image to be formed, wherein, when a position where the eccentricity of the rotation member is relatively large is moved to an image-forming position, the cumulative pitch error of the gear in the direction of rotation becomes relatively small at an engagement position of the gear, wherein, when a neighborhood of a phase where the eccentricity of the rotation member is approximately maximum is moved to an image-forming position, the cumulative pitch error of the gear in the direction of rotation becomes approximately minimum at an engaging position of the gear, and wherein marks are respectively provided at a position where the eccentricity of the rotation member becomes maximum and a position where the cumulative pitch error of the gear in the direction of rotation becomes minimum, and the gear is attached to the rotation member in accordance with the marks.

6. A rotation member driving device for rotating and driving a rotation member for forming an image, the device comprising:

a rotation member for forming an image, having an eccentricity; and a gear attached to the rotation member for rotating thereof, wherein a relation between a phase of the eccentricity of the rotation member and a phase of a cumulative pitch error in a direction of rotation of the gear is set so that a variation of a surface speed of the rotation member due to the eccentricity thereof is restrained from appearing on an image to be formed, wherein, when a position where the eccentricity of the rotation member is relatively large is moved to an image-forming position, the cumulative pitch error of the gear in the direction of rotation becomes relatively small at an engagement position of the gear, and wherein the image-forming position of the rotation member and the engagement position of the gear are set to be substantially opposite positions or substantially same positions.

* * * * *